US010007204B2

(12) United States Patent
Sumioka

(10) Patent No.: US 10,007,204 B2
(45) Date of Patent: Jun. 26, 2018

(54) ELECTROSTATIC LATENT IMAGE DEVELOPING TONER

(71) Applicant: KYOCERA Document Solutions Inc., Osaka (JP)

(72) Inventor: Sho Sumioka, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days. days.

(21) Appl. No.: 15/297,645

(22) Filed: Oct. 19, 2016

(65) Prior Publication Data

US 2017/0115587 A1 Apr. 27, 2017

(30) Foreign Application Priority Data

Oct. 27, 2015 (JP) ..... 2015-210557

(51) Int. Cl.

*G03G 9/093* (2006.01)
*G03G 9/087* (2006.01)
*G03G 9/08* (2006.01)

(52) U.S. Cl.

CPC ..... *G03G 9/09364* (2013.01); *G03G 9/0819* (2013.01); *G03G 9/0825* (2013.01); *G03G 9/08711* (2013.01); *G03G 9/09321* (2013.01); *G03G 9/09392* (2013.01)

(58) Field of Classification Search

CPC ..... G03G 9/08711; G03G 9/08755; G03G 9/08791; G03G 9/09321

See application file for complete search history.

(56) References Cited

U.S. PATENT DOCUMENTS 4,980,257 A 12/1990 Anno et al.
5,571,651 A * 11/1996 Inaba ..... G03G 9/09321 430/110.2

FOREIGN PATENT DOCUMENTS

JP H02-000880 A 1/1990
JP 2005-173202 * 6/2005 ..... G03G 9/08
JP 2009-186724 A 8/2009
JP 2012-230371 * 11/2012 ..... G03G 9/08

OTHER PUBLICATIONS

Translation of JP 2005-173202.*
Translation of JP 2012-230371.*
An Office Action issued by the Japanese Patent Office dated Mar. 20, 2018, which corresponds to Japanese Patent Application No. 2015-210557 and is related to U.S. Appl. No. 15/297,645; with English translation.

* cited by examiner

*Primary Examiner* — Peter L Vajda
(74) *Attorney, Agent, or Firm* — Studebaker & Brackett PC

(57) ABSTRACT

An electrostatic latent image developing toner includes toner particles each including a core and a shell layer disposed over a surface of the core. The shell layer contains first resin particles having a number average particle diameter of 60 nm to 100 nm and second resin particles having a number average particle diameter of 10 nm to 50 nm. A particle diameter difference obtained by subtracting the number average particle diameter of the second resin particles from the number average particle diameter of the first resin particles is +20 nm to +50 nm. The first resin particles contain a charge control agent. The first resin particles have a higher softening point than the second resin particles. A ratio of a mass of the first resin particles to a sum of the mass of the first resin particles and a mass of the second resin particles is 0.7 to 0.9.

16 Claims, 3 Drawing Sheets

ELECTROSTATIC LATENT IMAGE DEVELOPING TONER

INCORPORATION BY REFERENCE

The present application claims priority under 35 U.S.C. § 119 to Japanese Patent Application No. 2015-210557, filed on Oct. 27, 2015. The contents of this application are incorporated herein by reference in their entirety.

BACKGROUND

The present disclosure relates to an electrostatic latent image developing toner. More particularly, the present disclosure relates to a capsule toner.

Toner particles included in a capsule toner each have a core and a shell layer (capsule layer) disposed over a surface of the core. The shell layers covering the cores can improve high-temperature preservability of the toner. In one example of capsule toners, first thermoplastic resin fine particles and second thermoplastic resin fine particles are thermally fixed to the surface of each core.

SUMMARY

An electrostatic latent image developing toner according to an aspect of the present disclosure includes a plurality of toner particles each including a core and a shell layer disposed over a surface of the core. The shell layer contains first resin particles having a number average particle diameter of at least 60 nm and no greater than 100 nm, and second resin particles having a number average particle diameter of at least 10 nm and no greater than 50 nm. A particle diameter difference obtained by subtracting the number average particle diameter of the second resin particles from the number average particle diameter of the first resin particles is at least +20 nm and no greater than +50 nm. The first resin particles contain a charge control agent. The first resin particles have a higher softening point than a softening point of the second resin particles. A ratio of a mass of the first resin particles to a sum of the mass of the first resin particles and a mass of the second resin particles is at least 0.7 and no greater than 0.9.

DETAILED DESCRIPTION

Figure 1:
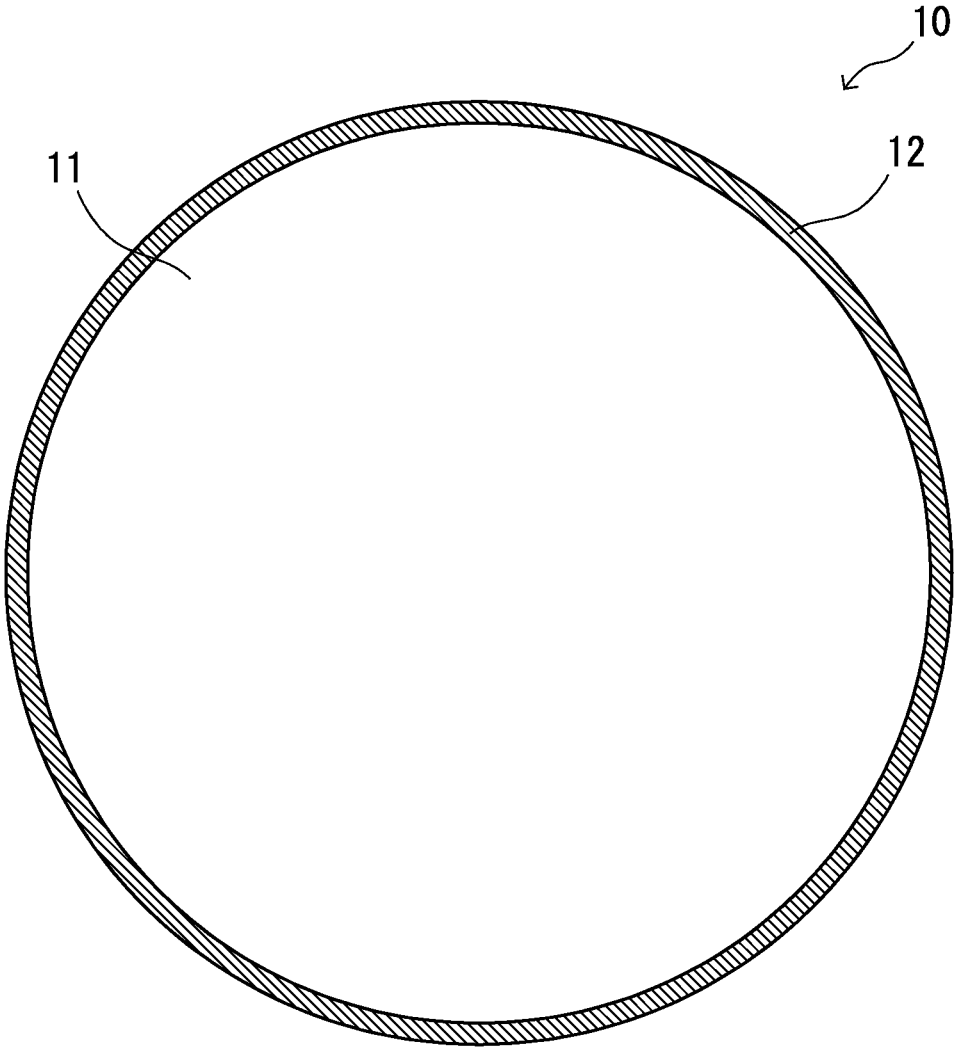
FIG. 1 is a diagram illustrating an example of a cross-section structure of a toner particle (particularly toner mother particle) included in an electrostatic latent image developing toner according to an embodiment of the present disclosure.

The following describes an embodiment of the present disclosure in detail. Evaluation results (for example, values indicating shape and physical properties) for a powder (specific examples include toner cores, toner mother particles, external additive, and toner) are each a number average of values measured for a suitable number of normal particles selected from the powder, unless otherwise stated.

A number average particle diameter of a powder is a number average of diameters of representative circles of primary particles (i.e., diameters of circles having the same area as projections of the particles) measured using a microscope, unless otherwise stated. A value for volume median diameter ($D_{50}$) of a powder is measured based on the Coulter principle (electrical sensing zone technique) using "Coulter Counter Multisizer 3" produced by Beckman Coulter, Inc., unless otherwise stated. A value for mean volume diameter (MV) of a powder is measured using a laser diffraction/light scattering-type particle size distribution analyzer ("LA-750", product of HORIBA, Ltd.), unless otherwise stated. A value for roundness (=perimeter of a circle having the same area as the projection area of the particle/perimeter of the real particle) is a number average of values measured for a suitable number of particles (for example, 3,000 particles) using a flow particle imaging analyzer ("FPIA (registered Japanese trademark)-3000", product of Sysmex Corporation), unless otherwise stated.

Acid values and hydroxyl values are measured in accordance with Japanese Industrial Standard (JIS) K0070-1992, unless otherwise stated. Values for number average molecular weight (Mn) and mass average molecular weight (Mw) are measured by gel permeation chromatography, unless otherwise stated. Values for zeta potential are measured by laser Doppler electrophoresis in an aqueous medium at 25° C. adjusted to pH 4, unless otherwise stated.

Chargeability refers to chargeability in triboelectric charging, unless otherwise stated. Strength of positive chargeability (or negative chargeability) in triboelectric charging can be confirmed by for example a known triboelectric series. Values for triboelectric charge are measured using standard carriers (anionic standard carrier: N-01, cationic standard carrier: P-01) provided by The Imaging Society of Japan, unless otherwise stated.

Note that in the present description the term "-based" may be appended to the name of a chemical compound in order to form a generic name encompassing both the chemical compound itself and derivatives thereof. When the term "-based" is appended to the name of a chemical compound used in the name of a polymer, the term indicates that a repeating unit of the polymer originates from the chemical compound or a derivative thereof. The term "(meth)acryl" is used as a generic term for both acryl and methacryl. The term "(meth)acryloyl" is used as a generic term for both acryloyl ($CH_2{=}CH{-}CO{-}$) and methacryloyl ($CH_2{=}C(CH_3){-}CO{-}$).

The toner according to the present embodiment can for example be favorably used as a positively chargeable toner for development of an electrostatic latent image. The toner according to the present embodiment is a powder including a plurality of toner particles (particles each having a structure described below). The toner may be used as a one-component developer. Alternatively, the toner may be mixed with a carrier using a mixer (for example, a ball mill) in order to prepare a two-component developer. In order to achieve high quality image formation, a ferrite carrier is preferably used as the carrier. In order to achieve high quality image formation over an extended period of time, magnetic carrier particles including carrier cores and resin layers coating the carrier cores are preferably used. In order that carrier particles are magnetic, carrier cores thereof may be formed from a magnetic material (for example, ferromagnetic material such as ferrite) or formed from a resin in which magnetic particles are dispersed. Alternatively, magnetic particles may be dispersed in resin layers coating carrier cores. Preferably, an amount of the toner in the two-component developer is at least 5 parts by mass and no greater than 15 parts by mass relative to 100 parts by mass of the carrier in order to achieve high quality image formation. Note that a positively chargeable toner included in a two-component developer is positively charged by friction against a carrier in the two-component developer.

Toner particles included in the toner according to the present embodiment each include a core (hereinafter, referred to as a toner core) and a shell layer (capsule layer) disposed over a surface of the toner core. The toner cores contain a binder resin. The toner cores may contain internal additives (for example, a colorant, a releasing agent, a charge control agent, and a magnetic powder). Either or both of the toner cores and the shell layers may have an external additive adhering to the surface thereof. The external additive may be omitted if unnecessary. In the present description, the term toner mother particles is used to refer to toner particles prior to adhesion of an external additive.

The toner according to the present embodiment can for example be used in image formation in an electrophotographic apparatus (image forming apparatus). The following describes an example of image forming methods that are performed by electrophotographic apparatuses.

First, an image forming section (a charger and a light exposure device) of an electrophotographic apparatus forms an electrostatic latent image on a photosensitive member (for example, on a surface of a photosensitive drum) based on image data. Next, the thus formed electrostatic latent image is developed using a developer containing a toner. In the developing step, the toner (for example, the toner charged by friction with a carrier or with a blade) on a development sleeve (for example, a surface of a development roller in a developing device) disposed in the vicinity of the photosensitive member is caused to adhere to the electrostatic latent image such that a toner image is formed on the photosensitive member. Subsequently, in a transfer step, the toner image on the photosensitive member is transferred onto an intermediate transfer member (for example, a transfer belt), and then further transferred onto a recording medium (for example, paper). Next, a fixing device (fixing method: nip fixing in which fixing is performed through a nip between a heating roller and a pressure roller) fixes the toner image to the recording medium by applying heat and pressure to the toner. As a result, an image is formed on the recording medium. A full-color image can for example be formed by superimposing toner images of four different colors: black, yellow, magenta, and cyan. The fixing method may be belt fixing in which fixing is performed using a belt.

The toner according to the present embodiment is an electrostatic latent image developing toner having a structure described below (hereinafter, referred to as a basic structure).

(Basic Structure of Toner)

The electrostatic latent image developing toner includes a plurality of toner particles each including a toner core and a shell layer. The shell layers contain first resin particles having a number average particle diameter of at least 60 nm and no greater than 100 nm, and second resin particles having a number average particle diameter of at least 10 nm and no greater than 50 nm. A particle diameter difference obtained by subtracting the number average particle diameter of the second resin particles from the number average particle diameter of the first resin particles (hereinafter, referred to as a first-second particle diameter difference) is at least +20 nm and no greater than +50 nm. The first resin particles contain a charge control agent. The first resin particles have a higher softening point (Tm) than the second resin particles. With respect to mass of the first resin particles (hereinafter, referred to as a first resin amount $M_A$) and mass of the second resin particles (hereinafter, referred to as a second resin amount $M_B$), a ratio (hereinafter, referred to as a first resin ratio $R_1$) of the first resin amount $M_A$ to a sum of the first resin amount $M_A$ and the second resin amount $M_B$ is at least 0.7 and no greater than 0.9. The first-second particle diameter difference being a positive value means that the number average particle diameter of the first resin particles is greater than the number average particle diameter of the second resin particles. The first resin ratio $R_1$ is represented by an equation "$R_1=M_A/(M_A+M_B)$".

The number average particle diameter of the first resin particles and the number average particle diameter of the second resin particles are each a number average of diameters of representative circles of primary particles (i.e., diameters of circles having the same area as projections of the particles) measured using a microscope. In a situation in which the resin particles are formed in a solution containing a surfactant, the number average particle diameter of the resin particles can be adjusted by changing the amount of the surfactant. The particle diameter of the resin particles to be formed tends to decrease with increase in the amount of the surfactant.

The softening point (Tm) of the first resin particles and the second resin particles is measured by a method to be described for Examples or by an alternative method. The softening point (Tm) of a resin can for example be adjusted by changing molecular weight or crosslinkability of the resin. The molecular weight of a resin can be adjusted by changing conditions for polymerization of the resin (more specifically, amount of a polymerization initiator to use, polymerization temperature, or polymerization time). For example, the molecular weight of the resin can be decreased by decreasing the polymerization temperature (reaction temperature during the polymerization), decreasing the amount of a solvent in which materials for synthesis of the resin are dissolved, or decreasing the amount of the polymerization initiator. If the amount of the polymerization initiator is decreased too much, the polymerization reaction may stop to result in more residual monomers (unreacted monomers). In a situation in which a cross-linking agent is used in synthesis of a resin, the crosslinkability of the resin to be synthesized can be adjusted by changing the amount of the cross-linking agent.

The shell layers in the toner having the above-described basic structure contain the second resin particles in addition to the first resin particles containing a charge control agent. The second resin particles have a lower softening point (Tm) and a smaller number average particle diameter than the first resin particles.

The inventor has found that sufficient low-temperature fixability of the toner is easily ensured under conditions of a number average particle diameter of the second resin particles of no greater than 50 nm, a first-second particle diameter difference of no greater than +50 nm, and a first resin ratio $R_1$ of no greater than 0.9 (see Tables 1 to 10 shown below). One of reasons for improvement in the low-temperature fixability of the toner is thought to be that the second resin particles serve as collapse points in each shell layer (regions of each shell layer that are particularly breakable by an external force or heating).

The inventor has also found that sufficient thermal-stress resistance of the toner is easily ensured under conditions of a number average particle diameter of the first resin particles of at least 60 nm and a number average particle diameter of the second resin particles of at least 10 nm (see Tables 1 to 10 shown below). One of reasons for improvement in the thermal-stress resistance of the toner is thought to be that sufficiently large number average particle diameters of the resin particles forming the shell layers make it easier to ensure sufficient strength of the shell layers.

The inventor has also found that sufficient charge stability of the toner is easily ensured under conditions of a number average particle diameter of the first resin particles of at least 60 nm, a first-second particle diameter difference of at least +20 nm, and a first resin ratio $R_1$ of at least 0.7 (see Tables 1 to 10 shown below). One of reasons for improvement in the charge stability of the toner is thought to be that the first resin particles, which are highly chargeable, protrude further outward from the surface of each toner particle than the second resin particles to be easily charged by friction against carrier particles in the developing device of the image forming apparatus. Furthermore, a sufficiently large first-second particle diameter difference allows the first resin particles to function as a spacer between the toner particles. As a result, aggregation of the toner particles tends to be inhibited.

In order to ensure sufficient high-temperature preservability of the toner, a percentage of area of regions of the surface of each toner core that are covered with at least one of the first and second resin particles is preferably at least 90% and no greater than 100%. Hereinafter, the percentage of area is referred to as a shell coverage $R_S$, and the regions are referred to as covered regions. The shell coverage $R_S$ is represented by an equation "$R_S=100\times S_S/S_C$", where the area of the whole surface of each toner core is $S_C$, and the area of the covered regions is $S_S$. The covered regions include a surface region of the toner core that is covered only with the first resin particles, a surface region of the toner core that is covered only with the second resin particles, and a surface region of the toner core that is covered with both the first resin particles and the second resin particles (more specifically, the first resin particles and the second resin particles stacked on one another). The shell coverage $R_S$ can for example be measured by analyzing an image of a toner particle (a preliminarily dyed toner particle) captured using a field-emission-type scanning electron microscope ("JSM-7600F", product of JEOL Ltd.). The covered regions can for example be distinguished from the other regions (uncovered regions) of the surface of the toner core according to different luminance values. Sufficient high-temperature preservability of the toner is easily ensured by ensuring a sufficiently high shell coverage $R_S$. The toner having the above-described basic structure can easily have sufficient low-temperature fixability because the second resin particles function as collapse points even if the shell coverage $R_S$ is 90% or greater.

In order to achieve both thermal-stress resistance and low-temperature fixability of the toner, a difference obtained by subtracting the softening point of the second resin particles from the softening point of the first resin particles (hereinafter, referred to as a softening point difference $T_{12}$) is preferably at least +10° C., and more preferably at least +15° C. Furthermore, in order to ensure sufficient easiness of manufacture of the toner without using special equipment or materials, the softening point difference $T_{12}$ is preferably no greater than +50° C.

In order to achieve both thermal-stress resistance and low-temperature fixability of the toner, the first resin particles particularly preferably have a softening point of at least 120° C. and no greater than 130° C., and the second resin particles particularly preferably have a softening point of at least 100° C. and no greater than 110° C.

Figure 2:
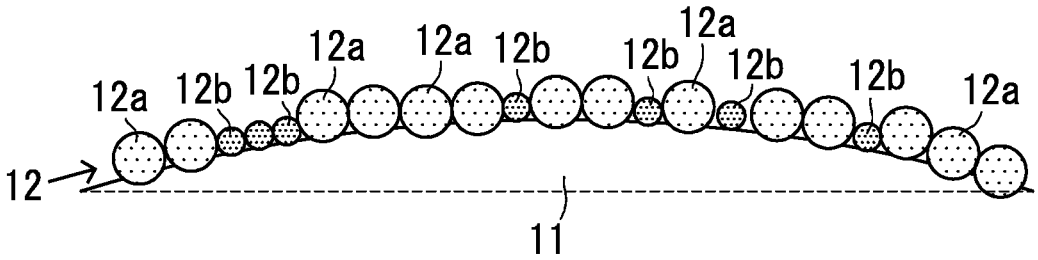
FIG. 2 is an enlarged view of a portion of a surface of the toner mother particle illustrated in FIG. 1.

The following describes an example of the structure of the toner particles included in the toner having the above-described basic structure with reference to FIGS. 1 and 2. FIG. 1 is a diagram illustrating an example of a structure of a toner particle (particularly a toner mother particle) included in the toner according to the present embodiment. FIG. 2 is an enlarged view of a portion of the toner mother particle illustrated in FIG. 1.

A toner mother particle 10 illustrated in FIG. 1 includes a toner core 11 and a shell layer 12 disposed over a surface of the toner core 11. The shell layer 12 covers the surface of the toner core 11.

As illustrated in FIG. 2, the shell layer 12 in the toner mother particle 10 contains spherical first resin particles 12*a* and spherical second resin particles 12*b*. The first resin particles 12*a* contain a charge control agent (for example, a quaternary ammonium salt), and the second resin particles 12*b* contain no charge control agent. In the example illustrated in FIG. 2, the first resin particles 12*a* and the second resin particles 12*b* are present in a single layer without forming a layered structure. A portion (bottom portion) of each of the first resin particles 12*a* and the second resin particles 12*b* may be embedded in the toner core 11 as illustrated in FIG. 2.

The toner according to the present embodiment includes a plurality of toner particles having the above-described basic structure (hereinafter, referred to as toner particles according to the present embodiment). The toner including the toner particles according to the present embodiment is thought to be excellent in low-temperature fixability, thermal-stress resistance, and charge stability (see Tables 1 to 10 shown below). In order to obtain such an effect, the toner preferably includes the toner particles according to the present embodiment in an amount of at least 80% by number, more preferably in an amount of at least 90% by number, and still more preferably in an amount of 100% by number. The toner may include toner particles having no shell layer in addition to the toner particles according to the present embodiment.

Toner cores prepared by a dry process tend to be compatible with the shell layers having the above-described basic structure. Particularly preferably, the dry process is a pulverization method. Accordingly, the toner cores are preferably pulverized cores (toner cores obtained by the pulverization method). The pulverization method involves melt-kneading a plurality of materials (such as a resin) to obtain a kneaded product and pulverizing the kneaded product to obtain a powder (for example, toner cores).

In order to form a high-quality image using the toner, the toner mother particles preferably have a roundness of at least 0.950 and less than 0.985.

In order to achieve both high-temperature preservability and low-temperature fixability of the toner, the toner mother particles preferably have a mean volume diameter (MV) of at least 1 μm and less than 10 μm.

The following describes materials for forming the toner cores (hereinafter, referred to as toner core materials) and materials for forming the shell layers (hereinafter, referred to as shell materials). Resins that are preferably used for forming the toner particles are as described below.

<Preferable Thermoplastic Resins>

Examples of thermoplastic resins that can be preferably used for forming the toner particles (particularly, toner cores and shell layers) include styrene-based resins, acrylic acid-based resins (specific examples include acrylic acid ester polymers and methacrylic acid ester polymers), olefin-based resins (specific examples include polyethylene resins and polypropylene resins), vinyl chloride resins, polyvinyl alcohol, vinyl ether resins, N-vinyl resins, polyester resins, polyamide resins, and urethane resins. Furthermore, copolymers of the resins listed above, that is, copolymers obtained through incorporation of a repeating unit into any of the resins listed above (specific examples include styrene-acrylic acid-based resins and styrene-butadiene-based resins) may be favorably used as thermoplastic resins for forming the toner particles.

A styrene-acrylic acid-based resin is a copolymer of at least one styrene-based monomer and at least one acrylic acid-based monomer. In order to synthesize the styrene-acrylic acid-based resin, for example following styrene-based monomers and acrylic acid-based monomers can be favorably used. A carboxyl group can be introduced into the styrene-acrylic acid-based resin by using an acrylic acid-based monomer having a carboxyl group. A hydroxyl group can be introduced into the styrene-acrylic acid-based resin by using a monomer having a hydroxyl group (specific examples include p-hydroxystyrene, m-hydroxystyrene, and hydroxyalkyl (meth)acrylate).

Examples of preferable styrene-based monomers include styrene, alkyl styrene (specific examples include α-methylstyrene, p-ethylstyrene, and 4-tert-butylstyrene), p-hydroxystyrene, m-hydroxystyrene, vinyltoluene, α-chlorostyrene, o-chlorostyrene, m-chlorostyrene, and p-chlorostyrene.

Examples of preferable acrylic acid-based monomers include (meth)acrylic acid, alkyl (meth)acrylates, and hydroxyalkyl (meth)acrylates. Examples of preferable alkyl (meth)acrylates include methyl (meth)acrylate, ethyl (meth) acrylate, n-propyl (meth)acrylate, iso-propyl (meth)acrylate, n-butyl (meth)acrylate, iso-butyl (meth)acrylate, and 2-ethylhexyl (meth)acrylate. Examples of preferable hydroxyalkyl (meth)acrylates include 2-hydroxyethyl (meth)acrylate, 3-hydroxypropyl (meth)acrylate, 2-hydroxypropyl (meth)acrylate, and 4-hydroxybutyl (meth)acrylate.

A polyester resin can be obtained through condensation polymerization of at least one polyhydric alcohol and at least one polycarboxylic acid. Examples of alcohols that can be preferably used in synthesis of the polyester resin include dihydric alcohols (specific examples include diols and bisphenols) and tri- or higher-hydric alcohols shown below. Examples of carboxylic acids that can be preferably used in synthesis of the polyester resin include di-, tri-, and higher-basic carboxylic acids shown below.

Examples of preferable diols include ethylene glycol, diethylene glycol, triethylene glycol, 1,2-propanediol, 1,3-propanediol, 1,4-butanediol, neopentyl glycol, 2-butene-1, 4-diol, 1,5-pentanediol, 1,6-hexanediol, 1,4-cyclohexanedimethanol, dipropylene glycol, polyethylene glycol, polypropylene glycol, and polytetramethylene glycol.

Examples of preferable bisphenols include bisphenol A, hydrogenated bisphenol A, bisphenol A ethylene oxide adduct, and bisphenol A propylene oxide adduct.

Examples of preferable tri- or higher-hydric alcohols include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Examples of preferable di-basic carboxylic acids include maleic acid, fumaric acid, citraconic acid, itaconic acid, glutaconic acid, phthalic acid, isophthalic acid, terephthalic acid, cyclohexanedicarboxylic acid, adipic acid, sebacic acid, azelaic acid, malonic acid, succinic acid, alkyl succinic acids (specific examples include n-butylsuccinic acid, isobutylsuccinic acid, n-octylsuccinic acid, n-dodecylsuccinic acid, and isododecylsuccinic acid), and alkenyl succinic acids (specific examples include n-butenylsuccinic acid, isobutenylsuccinic acid, n-octenylsuccinic acid, n-dodecenylsuccinic acid, and isododecenylsuccinic acid).

Examples of preferable tri- or higher-basic carboxylic acids include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid.

The following describes, in order, the toner cores (a binder resin and internal additives), the shell layers, and external additives. Non-essential components (for example, internal additives or external additives) may be omitted in accordance with the intended use of the toner.

[Toner Cores]

(Binder Resin)

Typically, the binder resin is a main component (for example, at least 85% by mass) of the toner cores. Accordingly, properties of the binder resin are thought to have a great influence on overall properties of the toner cores. Properties (specific examples include hydroxyl value, acid value, glass transition point, and softening point) of the binder resin can be adjusted by using different resins in combination for the binder resin. The toner cores have a higher tendency to be anionic in a situation in which the binder resin has for example an ester group, a hydroxyl group, an ether group, an acid group, or a methyl group, and have a higher tendency to be cationic in a situation in which the binder resin has for example an amino group or an amide group. In order that the binder resin has high anionic strength, the binder resin preferably has a hydroxyl value and an acid value that are each at least 10 mg KOH/g.

The binder resin is preferably a resin having one or more functional groups selected from the group consisting of an ester group, a hydroxyl group, an ether group, an acid group, and a methyl group. The binder resin having a functional group such as described above readily reacts with the shell materials to form chemical bonds. Formation of chemical bonds ensures that the toner cores are strongly bound to the shell layers. Furthermore, the binder resin preferably has an activated hydrogen-containing functional group in molecules thereof.

In order to improve fixability of the toner during high speed fixing, the binder resin preferably has a glass transition point (Tg) of at least 20° C. and no greater than 55° C. In order to improve fixability of the toner during high speed fixing, the binder resin preferably has a softening point (Tm) of no greater than 100° C. Tg and Tm are measured by methods to be described for Examples or by alternative methods. Either or both of Tg and Tm of the binder resin can be adjusted by changing the type or the amount of components (monomers) of the resin.

The toner according to the present embodiment has the above-described basic structure. The toner cores of the toner according to the present embodiment contain at least one polyester resin. The toner cores may contain only a polyester resin as the binder resin or may contain a resin other than the polyester resin (specific examples include those mentioned in "Preferable Thermoplastic Resins") as the binder resin. In order to improve colorant dispersibility in the toner, chargeability of the toner, and fixability of the toner to a recording medium, it is preferable to use either or both of a styrene-acrylic acid-based resin and a polyester resin as the binder resin. In order to obtain a toner having excellent low-temperature fixability, the polyester resin preferably accounts for at least 80% by mass of the resin contained in the toner cores, more preferably at least 90% by mass of the resin, and still more preferably 100% by mass of the resin.

In a situation in which the polyester resin is used as the binder resin of the toner cores, the polyester resin preferably has a number average molecular weight (Mn) of at least 1,000 and no greater than 2,000 in order to improve toner core strength and toner fixability. The polyester resin preferably has a molecular weight distribution (ratio Mw/Mn of mass average molecular weight (Mw) to number average molecular weight (Mn)) of at least 9 and no greater than 21.

(Colorant)

The toner cores may contain a colorant. A known pigment or dye matching a color of the toner can be used as a colorant. In order to achieve high quality image formation using the toner, the amount of the colorant is preferably at least 1 part by mass and no greater than 20 parts by mass relative to 100 parts by mass of the binder resin.

The toner cores may contain a black colorant. Carbon black can for example be used as a black colorant. Alternatively, a colorant that is adjusted to a black color using a yellow colorant, a magenta colorant, and a cyan colorant can for example be used as a black colorant.

The toner cores may include a non-black colorant such as a yellow colorant, a magenta colorant, or a cyan colorant.

The yellow colorant that can be used is for example one or more compounds selected from the group consisting of condensed azo compounds, isoindolinone compounds, anthraquinone compounds, azo metal complexes, methine compounds, and arylamide compounds. Examples of yellow colorants that can be preferably used include C.I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, or 194), Naphthol Yellow S, Hansa Yellow G, and C.I. Vat Yellow.

The magenta colorant that can be used is for example one or more compounds selected from the group consisting of condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. Examples of magenta colorants that can be preferably used include C.I. Pigment Red (2, 3, 5, 6, 7, 19, 23, 48:2, 48:3, 48:4, 57:1, 81:1, 122, 144, 146, 150, 166, 169, 177, 184, 185, 202, 206, 220, 221, or 254).

The cyan colorant that can be used is for example one or more compounds selected from the group consisting of copper phthalocyanine compounds, anthraquinone compounds, and basic dye lake compounds. Examples of cyan colorants that can be preferably used include C.I. Pigment Blue (1, 7, 15, 15:1, 15:2, 15:3, 15:4, 60, 62, or 66), Phthalocyanine Blue, C.I. Vat Blue, and C.I. Acid Blue.

(Releasing Agent)

The toner cores may contain a releasing agent. A releasing agent is for example used in order to improve fixability or offset resistance of the toner. In order to increase the anionic strength of the toner cores, the toner cores are preferably prepared using an anionic wax. In order to improve fixability or offset resistance of the toner, the amount of the releasing agent is preferably at least 1 part by mass and no greater than 30 parts by mass relative to 100 parts by mass of the binder resin.

Examples of releasing agents that can be preferably used include: aliphatic hydrocarbon waxes such as low molecular weight polyethylene, low molecular weight polypropylene, polyolefin copolymer, polyolefin wax, microcrystalline wax, paraffin wax, and Fischer-Tropsch wax; oxides of aliphatic hydrocarbon waxes such as polyethylene oxide wax and block polymer of polyethylene oxide wax; plant waxes such as candelilla wax, carnauba wax, Japan wax, jojoba wax, and rice wax; animal waxes such as beeswax, lanolin, and spermaceti; mineral waxes such as ozokerite, ceresin, and petrolatum; waxes having a fatty acid ester as a main component such as montanic acid ester wax and castor wax; and waxes in which a fatty acid ester is partially or fully deoxidized such as deoxidized carnauba wax. One releasing agent may be used independently, or two or more releasing agents may be used in combination.

In order to improve compatibility between the binder resin and the releasing agent, a compatibilizer may be added to the toner cores.

(Charge Control Agent)

The toner cores may contain a charge control agent. The charge control agent is for example used in order to improve charge stability or a charge rise characteristic of the toner. The charge rise characteristic of the toner is an indicator as to whether the toner can be charged to a specific charge level in a short period of time.

The anionic strength of the toner cores can be increased by including a negatively chargeable charge control agent (specific examples include organic metal complexes and chelate compounds) in the toner cores. The cationic strength of the toner cores can be increased by including a positively chargeable charge control agent (specific examples include pyridine, nigrosine, and quaternary ammonium salts) in the toner cores. However, when it is ensured that the toner has sufficient chargeability, the toner cores do not need to contain a charge control agent.

(Magnetic Powder)

The toner cores may contain a magnetic powder. Examples of materials of the magnetic powder that can be preferably used include ferromagnetic metals (specific examples include iron, cobalt, and nickel) or alloys thereof, ferromagnetic metal oxides (specific examples include ferrite, magnetite, and chromium dioxide), and materials subjected to ferromagnetization (specific examples include thermal treatment). One magnetic powder may be used independently, or two or more magnetic powders may be used in combination.

The magnetic powder is preferably subjected to surface treatment in order to inhibit elution of metal ions (for example, iron ions) from the magnetic powder. In a situation in which the shell layers are formed on the surface of the toner cores under acidic conditions, elution of metal ions to the surface of the toner cores causes the toner cores to adhere to one another more readily. It is thought that inhibiting elution of metal ions from the magnetic powder thereby inhibits the toner cores from adhering to one another.

[Shell Layers]

The toner according to the present embodiment has the above-described basic structure. The shell layers contain the first resin particles and the second resin particles.

In order to obtain a toner that is excellent in chargeability, high-temperature preservability, and low-temperature fixability, both the first resin particles and the second resin particles are substantially composed of a thermoplastic resin (specific examples include those mentioned in "Preferable Thermoplastic Resins").

In a configuration in which the toner cores contain a polyester resin, the first resin particles preferably contain a styrene-acrylic acid-based resin (specific examples include a copolymer of styrene and acrylic acid ester) in order to improve positive chargeability and low-temperature fixability of the toner. The styrene-acrylic acid-based resin has excellent positive chargeability and good compatibility with the polyester resin (binder resin of the toner cores). In a configuration in which the first resin particles contain a styrene-acrylic acid-based resin, requirements (such as Tm) specified for the above-described basic structure are readily satisfied. The styrene-acrylic acid-based resin (specific examples include a copolymer of styrene and acrylic acid ester) is suitable as a material of the second resin particles. The styrene-acrylic acid-based resin is more hydrophobic and has a higher tendency to be positively charged than the polyester resin.

In order to improve low-temperature fixability of the toner, the second resin particles preferably contain a polyester resin. In a configuration in which the second resin particles contain a polyester resin, the second resin particles readily function as collapse points.

The first resin particles contain a charge control agent. In order that the first resin particles contain a charge control agent, a repeating unit derived from the charge control agent may be incorporated into the resin for forming the first resin particles or charged particles may be dispersed in the resin for forming the first resin particles. However, in order to obtain a toner that is excellent in charge stability, thermal-stress resistance, and low-temperature fixability, it is preferable that the first resin particles are substantially composed of a resin having a repeating unit derived from a charge control agent, and it is particularly preferable that the first resin particles are substantially composed of a resin having a repeating unit derived from a (meth)acryloyl group-containing quaternary ammonium compound. More specifically, the resin forming the first resin particles preferably have a repeating unit represented by formula (1) shown below or a salt thereof. Examples of (meth)acryloyl group-containing quaternary ammonium compounds that can be preferably used include (meth)acrylamidoalkyltrimethylammonium salts (specific examples include (3-acrylamidopropyl)trimethylammonium chloride) and (meth)acryloyloxyalkyltrimethylammonium salts (specific examples include 2-(methacryloyloxy)ethyltrimethylammonium chloride).

(1)

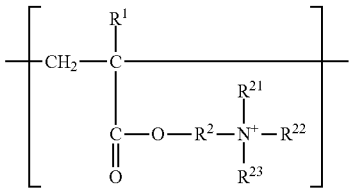

In the formula (1), $R^1$ represents a hydrogen atom or a methyl group, $R^{21}$, $R^{22}$, and $R^{23}$ each represent, independently of one another, a hydrogen atom, an optionally substituted alkyl group, or an optionally substituted alkoxy group, and $R^2$ represents an optionally substituted alkylene group. $R^{21}$, $R^{22}$, and $R^{23}$ preferably each represent, independently of one another, an alkyl group having a carbon number of at least 1 and no greater than 8, and particularly preferably a methyl group, an ethyl group, a n-propyl group, an iso-propyl group, a n-butyl group, or an iso-butyl group. $R^2$ preferably represents an alkylene group having a carbon number of at least 1 and no greater than 6, and particularly preferably a methylene group or an ethylene group. In a repeating unit derived from 2-(methacryloyloxy)ethyltrimethylammonium chloride, $R^1$ represents a methyl group, $R^2$ represents an ethylene group, and $R^{21}$ to $R^{23}$ each represent a methyl group. A salt thereof is formed through ionic bonding between a quaternary ammonium cation ($N^+$) and chlorine (Cl).

A resin having the repeating unit represented by the formula (1) is obtained through addition polymerization of a quaternary ammonium compound represented by formula (A) shown below.

(A)

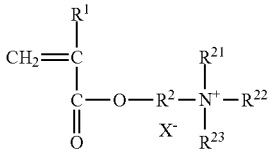

In the formula (A), $R^1$ represents a hydrogen atom or a methyl group, $R^{21}$, $R^{22}$ and $R^{23}$ each represent, independently of one another, a hydrogen atom, an optionally substituted alkyl group, or an optionally substituted alkoxy group, $R^2$ represents an optionally substituted alkylene group, and $X^-$ represents an anion forming an ionic bond with N in the formula (A). $R^{20}$, $R^{22}$, and $R^{23}$ preferably each represent, independently of one another, an alkyl group having a carbon number of at least 1 and no greater than 8, and particularly preferably a methyl group, an ethyl group, a n-propyl group, an iso-propyl group, a n-butyl group, or an iso-butyl group. $R^2$ preferably represents an alkylene group having a carbon number of at least 1 and no greater than 6, and particularly preferably a methylene group or an ethylene group. In 2-(methacryloyloxy)ethyltrimethylammonium chloride, $R^1$ represents a methyl group, $R^2$ represents an ethylene group, $R^{21}$ to $R^{23}$ each represent a methyl group, and X-represents a chloro group ($Cl^-$).

In a first preferable example of the toner, the toner cores contain a polyester resin, the first resin particles in the shell layers contain a styrene-acrylic acid-based resin (hereinafter, referred to as a first styrene-acrylic acid-based resin), and the second resin particles in the shell layers contain a styrene-acrylic acid-based resin (hereinafter, referred to as a second styrene-acrylic acid-based resin). The first styrene-acrylic acid-based resin and the second styrene-acrylic acid-based resin in the first preferable example may be resins having the same monomer composition as one another or may be resins having different monomer compositions from one another. Preferably, the first styrene-acrylic acid-based resin and the second styrene-acrylic acid-based resin are each a polymer of a styrene-based monomer, an alkyl(meth)acrylate, and a (meth)acryloyl group-containing quaternary ammonium compound (particularly preferably, the quaternary ammonium compound represented by the formula (A)). Examples of preferable styrene-based monomers include styrene, alkyl styrene, hydroxystyrene, and chlorostyrene.

In a second preferable example of the toner, the toner cores contain a polyester resin (hereinafter, referred to as a first polyester resin), the first resin particles in the shell layers contain an acrylic acid-based resin having a repeating unit derived from a (meth)acryloyl group-containing quaternary ammonium compound, and the second resin particles in the shell layers contain a polyester resin (hereinafter, referred to as a second polyester resin). The first polyester resin and the second polyester resin in the second preferable example may be resins having the same monomer composition as one another or may be resins having different monomer compositions from one another. Preferably, the acrylic acid-based resin having a repeating unit derived from a (meth)acryloyl group-containing quaternary ammonium compound is a polymer of an alkyl (meth)acrylate and the quaternary ammonium compound represented by the formula (A).

In a third preferable example of the toner, the first resin particles in the shell layers contain an acrylic acid-based resin having a repeating unit derived from a (meth)acryloyl group-containing quaternary ammonium compound, and the second resin particles in the shell layers contain an acrylic acid-based resin containing no charge control agent. Preferably, the acrylic acid-based resin having a repeating unit derived from a (meth)acryloyl group-containing quaternary ammonium compound in the third preferable example is a polymer of an alkyl (meth)acrylate and the quaternary ammonium compound represented by the formula (A).

Since the first resin particles in the toner having the above-described basic structure contain a charge control agent, it is thought that sufficient chargeability of the toner can be ensured even though the second resin particles contain no charge control agent. Furthermore, it is preferable that the second resin particles contain no charge control agent in order to increase charge stability of the toner. However, the second resin particles, as well as the first resin particles, may contain a charge control agent if necessary.

[External Additive]

The surface of the toner mother particles may have inorganic particles adhering thereto as an external additive. For example, the toner mother particles (powder) and the external additive (powder of inorganic particles) are stirred together, so that a portion (bottom portion) of each of the inorganic particles is embedded in the surface of the toner mother particles. Thus, the inorganic particles are caused to adhere to the surface of the toner mother particles by physical force (physical connection). The external additive is for example used in order to improve fluidity or handleability of the toner. In order to improve fluidity or handleability of the toner, the amount of the external additive is preferably at least 0.5 parts by mass and no greater than 10 parts by mass relative to 100 parts by mass of the toner mother particles. Furthermore, in order to improve fluidity or handleability of the toner, the external additive preferably has a particle diameter of at least 0.01 μm and no greater than 1.0 μm.

Examples of external additive particles (inorganic particles) that can be preferably used include silica particles and particles of metal oxides (specific examples include alumina, titanium oxide, magnesium oxide, zinc oxide, strontium titanate, and barium titanate). One type of external additive particles may be used independently, or a plurality of different types of external additive particles may be used in combination.

[Toner Production Method]

The following describes an example of a method for producing the toner according to the present embodiment having the above-described structure.

(Toner Core Preparation)

In order to readily obtain suitable toner cores, the toner cores are preferably prepared by an aggregation method or a pulverization method, and more preferably prepared by a pulverization method.

The following describes an example of the pulverization method. First, a binder resin and an internal additive (for example, at least one of a colorant, a releasing agent, a charge control agent, and a magnetic powder) are mixed. Next, the resultant mixture is melt-kneaded. Next, the resultant melt-kneaded product is pulverized and classified. As a result, toner cores having a desired particle diameter are obtained.

The following describes an example of the aggregation method. First, fine particles of a binder resin, a releasing agent, and a colorant are caused to aggregate in an aqueous medium until the particles have a desired particle diameter. Through the above, aggregated particles containing the binder resin, the releasing agent, and the colorant are formed. Next, the resultant aggregated particles are heated to cause components of the aggregated particles to coalesce. As a result, a dispersion of toner cores is obtained. Next, non-essential substances (surfactant and the like) are removed from the dispersion of the toner cores to give the toner cores.

(Shell Layer Formation)

First, an aqueous medium (for example, ion exchanged water) is prepared. In order to inhibit dissolution or elution of the toner core materials (in particular, the binder resin and the releasing agent) during the formation of the shell layers, the formation of the shell layers is preferably carried out in an aqueous medium. The aqueous medium is a medium in which water is a main component (specific examples include pure water and a liquid mixture of water and a polar medium). The aqueous medium may function as a solvent. Solute may be dissolved in the aqueous medium. The aqueous medium may function as a dispersion medium. Dispersoid may be dispersed in the aqueous medium. Examples of polar media that can be used for the aqueous medium include alcohols (specific examples include methanol and ethanol). The aqueous medium has a boiling point of approximately 100° C.

Next, the aqueous medium is adjusted to a desired pH (for example, pH 4) for example using hydrochloric acid. Next, the toner cores, a dispersion of the first resin particles (resin particles containing a charge control agent), and a dispersion of the second resin particles (resin particles containing no charge control agent) are added to the pH adjusted aqueous medium (for example, an acidic aqueous medium).

The first resin particles and the second resin particles adhere to the surface of the toner cores in the liquid. In order that the first resin particles and the second resin particles adhere to the surface of the toner cores in a uniform manner, a high degree of dispersion of the toner cores is preferably achieved in the liquid containing the first resin particles and the second resin particles. In order to achieve a high degree of dispersion of the toner cores in the liquid, a surfactant may be added to the liquid, or the liquid may be stirred using a powerful stirrer (for example, "Hivis Disper Mix", product of PRIMIX Corporation). In a situation in which the toner cores are anionic, aggregation of the toner cores can be inhibited by using an anionic surfactant having the same polarity. Examples of surfactants that can be used include sulfate ester salt surfactants, sulfonic acid salt surfactants, phosphate acid ester salt surfactants, and soaps.

Next, the liquid containing the toner cores, the first resin particles, and the second resin particles is heated under stirring to a predetermined constant temperature (for example, a temperature selected from the range of from 50° C. to 85° C.) at a predetermined heating rate (for example, a rate selected from the range of from 0.1° C./minute to 3.0° C./minute). Preferably, the heating rate is at least 1° C./minute and no greater than 3° C./minute. A too high heating rate may cause curing of the shell materials to start before spheroidizing of the toner cores due to surface tension. A too low heating rate may cause softening and aggregation of the toner cores before curing of the shell materials.

The liquid is maintained at the constant temperature under stirring for a predetermined period of time (for example, a period of time selected from the range of from 30 minutes to 4 hours). Thereafter, rapid cooling is performed on the liquid through addition of cold water to give a dispersion of toner mother particles. The shell materials (the first and second resin particles) adhere to the surface of the toner cores while the liquid is maintained at a high temperature (or while the liquid is being heated). The shell materials are bonded to the toner cores. It is thought that grainy films (shell layers) are formed as a result of the resin particles two-dimensionally laying side by side on the surface of the toner cores.

(Washing Process)

The toner mother particles obtained as described above may be washed. An example of a preferable method for washing the toner mother particles is a method involving collecting a wet cake of the toner mother particles from the dispersion containing the toner particles through solid-liquid separation and washing the collected wet cake of the toner mother particles using water. Another example of a preferable method for washing the toner mother particles is a method involving causing sedimentation of the toner mother particles in the dispersion containing the toner mother particles, substituting a supernatant with water, and re-dispersing the toner mother particles in the water after the substitution.

(Drying Process)

After the washing process, the toner mother particles may be dried. The toner mother particles can for example be dried using a dryer (specific examples include a spray dryer, a fluidized bed dryer, a vacuum freeze dryer, and a reduced pressure dryer). In order to inhibit aggregation of the toner mother particles during drying, the toner mother particles are preferably dried using a spray dryer. For example, in a situation in which a spray dryer is used, a dispersion of an external additive can be sprayed onto the toner mother particles. Through the above, the drying process and an external additive addition process to be described later can be performed at the same time.

(External Additive Addition Process)

The toner mother particles and an external additive may be mixed using a mixer (for example, an FM mixer or a UM mixer produced by Nippon Coke & Engineering Co., Ltd.) to cause the external additive to adhere to the surface of the toner mother particles. The toner including a plurality of toner particles is obtained as described above.

Procedures and the order of the processes in the above-described toner production method may be changed as appropriate in accordance with desired structure or properties of the toner. The toner may be sifted after the external additive addition process. Furthermore, non-essential processes may be omitted. In a situation in which a commercially available product can be used as is as a material, for example, a process of preparing the material can be omitted by using the commercially available product. In a situation in which the reaction for formation of the shell layers proceeds favorably without pH of the liquid being adjusted, the step of adjusting the pH may be omitted. In a situation in which an external additive is not necessary, the external additive addition process may be omitted. In a situation in which an external additive is not caused to adhere to the surface of the toner mother particles (i.e., the external additive addition process is omitted), the toner mother particles are equivalent to the toner particles. A prepolymer may be used instead of a monomer as a material for synthesizing a resin (for example, the toner core material or the shell materials) as necessary. In order to obtain a specific compound, a salt, an ester, a hydrate, or an anhydride of the compound may be used as a material thereof. Preferably, a large number of the toner particles are formed at the same time in order that the toner can be produced efficiently. Toner particles that are produced at the same time are thought to have substantially the same structure as one another.

Examples

The following describes Examples of the present disclosure. Tables 1 to 5 show toners T-1 to T-15, T-21 to T-38, T-41 to T-52, T-61 to T-68, and T-71 to T-78, each of which is an electrostatic latent image developing toner, according to Examples or Comparative Examples. Tables 6 and 7 show dispersions A-1 to A-6, A-21 to A-25, B-1 to B-6, B-51 to B-54, C, D-1, and D-2 that were each used for production of any of the toners T-1 to T-78. In Tables 1 to 5, "First resin" represents a first shell material (dispersion of resin particles containing a positively chargeable charge control agent), and "Second resin" represents a second shell material (dispersion of resin particles containing no charge control agent). In columns "Tm relationship" in Tables 1 to 5, "Satisfied" indicates that the following relationship was satisfied, and "Not Satisfied" indicates that the relationship was not satisfied: the first shell material has a higher resin softening point (Tm) than the second shell material.

TABLE 1

| | First resin (Positively chargeable) | | Second Resin (Non-chargeable) | | Relationship between first and second resins | | |
|---|---|---|---|---|---|---|---|
| Toner | Type | Amount [g] | Type | Amount [g] | Particle diameter difference (First − Second) [nm] | Resin mass ratio (First:Second) | Tm relationship (First > Second) |
| T-1 | A-2 | 36 | B-5 | 4 | +50 (=100 − 50) | 9:1 | Satisfied |
| T-2 | A-1 | | B-4 | | +50 (=60 − 10) | | |
| T-3 | A-1 | 32 | B-4 | 8 | +50 (=60 − 10) | 8:2 | |
| T-4 | A-2 | | B-5 | | +50 (=100 − 50) | | |
| T-5 | A-1 | 28 | B-4 | 12 | +50 (=60 − 10) | 7:3 | |
| T-6 | A-2 | | B-5 | | +50 (=100 − 50) | | |
| T-7 | A-1 | 36 | B-6 | 4 | +20 (=60 − 40) | 9:1 | |
| T-8 | A-3 | | B-5 | | +20 (=70 − 50) | | |
| T-9 | A-1 | 32 | B-6 | 8 | +20 (=60 − 40) | 8:2 | |
| T-10 | A-3 | | B-5 | | +20 (=70 − 50) | | |
| T-11 | A-1 | 28 | B-6 | 12 | +20 (=60 − 40) | 7:3 | |

TABLE 1-continued

| | First resin (Positively chargeable) | | Second Resin (Non-chargeable) | | Relationship between first and second resins: Particle diameter difference | | |
|---|---|---|---|---|---|---|---|
| Toner | Type | Amount [g] | Type | Amount [g] | (First − Second) [nm] | Resin mass ratio (First:Second) | Tm relationship (First > Second) |
| T-12 | A-3 | | B-5 | | +20 (=70 − 50) | | |
| T-13 | C | 36 | D-2 | 4 | +50 (=100 − 50) | 9:1 | |
| T-14 | C | | D-2 | | +50 (=100 − 50) | | |
| T-15 | C | | D-1 | | +50 (=100 − 50) | | |

TABLE 2

| | First resin (Positively chargeable) | | Second Resin (Non-chargeable) | | Relationship between first and second resins: Particle diameter difference | | |
|---|---|---|---|---|---|---|---|
| Toner | Type | Amount [g] | Type | Amount [g] | (First − Second) [nm] | Resin mass ratio (First:Second) | Tm relationship (First > Second) |
| T-21 | A-21 | 36 | B-4 | 4 | +55 (=65 − 10) | 9:1 | Satisfied |
| T-22 | A-1 | | B-51 | | +55 (=60 − 5) | | |
| T-23 | A-22 | | B-4 | | +45 (=55 − 10) | | |
| T-24 | A-23 | | B-6 | | +55 (=95 − 40) | | |
| T-25 | A-24 | | B-5 | | +55 (=105 − 50) | | |
| T-26 | A-2 | | B-52 | | +45 (=100 − 55) | | |
| T-27 | A-21 | 32 | B-4 | 8 | +55 (=65 − 10) | 8:2 | |
| T-28 | A-1 | | B-51 | | +55 (=60 − 5) | | |
| T-29 | A-22 | | B-4 | | +45 (=55 − 10) | | |
| T-30 | A-23 | | B-6 | | +55 (=95 − 40) | | |
| T-31 | A-24 | | B-5 | | +55 (=105 − 50) | | |
| T-32 | A-2 | | B-52 | | +45 (=100 − 55) | | |
| T-33 | A-21 | 28 | B-4 | 12 | +55 (=65 − 10) | 7:3 | |
| T-34 | A-1 | | B-51 | | +55 (=60 − 5) | | |
| T-35 | A-22 | | B-4 | | +45 (=55 − 10) | | |
| T-36 | A-23 | | B-6 | | +55 (=95 − 40) | | |
| T-37 | A-24 | | B-5 | | +55 (=105 − 50) | | |
| T-38 | A-2 | | B-52 | | +45 (=100 − 55) | | |

TABLE 3

| | First resin (Positively chargeable) | | Second Resin (Non-chargeable) | | Relationship between first and second resins: Particle diameter difference | | |
|---|---|---|---|---|---|---|---|
| Toner | Type | Amount [g] | Type | Amount [g] | (First − Second) [nm] | Resin mass ratio (First:Second) | Tm relationship (First > Second) |
| T-41 | A-1 | 36 | B-53 | 4 | +15 (=60 − 45) | 9:1 | Satisfied |
| T-42 | A-25 | | B-52 | | +20 (=75 − 55) | | |
| T-43 | A-22 | | B-54 | | +20 (=55 − 35) | | |
| T-44 | A-21 | | B-5 | | +15 (=65 − 50) | | |
| T-45 | A-1 | 32 | B-53 | 8 | +15 (=60 − 45) | 8:2 | |
| T-46 | A-25 | | B-52 | | +20 (=75 − 55) | | |
| T-47 | A-22 | | B-54 | | +20 (=55 − 35) | | |
| T-48 | A-21 | | B-5 | | +15 (=65 − 50) | | |
| T-49 | A-1 | 28 | B-53 | 12 | +15 (=60 − 45) | 7:3 | |
| T-50 | A-25 | | B-52 | | +20 (=75 − 55) | | |
| T-51 | A-22 | | B-54 | | +20 (=55 − 35) | | |
| T-52 | A-21 | | B-5 | | +15 (=65 − 50) | | |

TABLE 4

| Toner | First resin (Positively chargeable) Type | Amount [g] | Second Resin (Non-chargeable) Type | Amount [g] | Relationship between first and second resins: Particle diameter difference (First − Second) [nm] | Resin mass ratio (First:Second) | Tm relationship (First > Second) |
|---|---|---|---|---|---|---|---|
| T-61 | A-1 | 38 | B-4 | 2 | +50 (=60 − 10) | 9.5:0.5 | Satisfied |
| T-62 | A-2 | | B-5 | | +50 (=100 − 50) | | |
| T-63 | A-1 | 26 | B-4 | 14 | +50 (=60 − 10) | 6.5:3.5 | |
| T-64 | A-2 | | B-5 | | +50 (=100 − 50) | | |
| T-65 | A-1 | 38 | B-6 | 2 | +20 (=60 − 40) | 9.5:0.5 | |
| T-66 | A-3 | | B-5 | | +20 (=70 − 50) | | |
| T-67 | A-1 | 26 | B-6 | 14 | +20 (=60 − 40) | 6.5:3.5 | |
| T-68 | A-3 | | B-5 | | +20 (=70 − 50) | | |

TABLE 5

| Toner | First resin (Positively chargeable) Type | Amount [g] | Second Resin (Non-chargeable) Type | Amount [g] | Relationship between first and second resins: Particle diameter difference (First − Second) [nm] | Resin mass ratio (First:Second) | Tin relationship (First > Second) |
|---|---|---|---|---|---|---|---|
| T-71 | A-4 | 4 | B-1 | 36 | −50 (=10 − 60) | 1:9 | Not Satisfied |
| T-72 | A-5 | | B-2 | | −50 (=50 − 100) | | |
| T-73 | A-4 | 12 | B-1 | 28 | −50 (=10 − 60) | 3:7 | |
| T-74 | A-5 | | B-2 | | −50 (=50 − 100) | | |
| T-75 | A-6 | 4 | B-1 | 36 | −20 (=40 − 60) | 1:9 | |
| T-76 | A-5 | | B-3 | | −20 (=50 − 70) | | |
| T-77 | A-6 | 12 | B-1 | 28 | −20 (=40 − 60) | 3:7 | |
| T-78 | A-5 | | B-3 | | −20 (=50 − 70) | | |

TABLE 6

| Dispersion | Quaternary compound | Polymerization initiator: Before heating [g] | Polymerization initiator: After heating [g] | Surfactant [g] | Tg [° C.] | Tm [° C.] | Particle diameter [mn] |
|---|---|---|---|---|---|---|---|
| A-1 | Present | 14 | 12 | 1.65 | 59 | 122 | 60 |
| A-2 | | 12 | | 1.00 | 60 | 125 | 100 |
| A-3 | | 10 | | 1.35 | 61 | 128 | 70 |
| B-1 | Absent | 14 | | 1.65 | 59 | 122 | 60 |
| B-2 | | 12 | | 1.00 | 60 | 125 | 100 |
| B-3 | | 10 | | 1.35 | 61 | 128 | 70 |
| A-21 | Present | 12 | | 1.45 | 60 | 125 | 65 |
| A-22 | | | | 1.75 | | | 55 |
| A-23 | | | | 1.05 | | | 95 |
| A-24 | | | | 0.95 | | | 105 |
| A-25 | | | | 1.25 | | | 75 |
| B-4 | Absent | 22 | 12 | 10.00 | 61 | 108 | 10 |
| B-5 | | 24 | | 2.00 | 58 | 105 | 50 |
| B-6 | | 26 | | 2.50 | 57 | 102 | 40 |
| A-4 | Present | 22 | | 10.00 | 61 | 108 | 10 |
| A-5 | | 24 | | 2.00 | 58 | 105 | 50 |
| A-6 | | 26 | | 2.50 | 57 | 102 | 40 |
| B-51 | Absent | 24 | | 20.00 | 58 | 105 | 5 |
| B-52 | | | | 1.80 | | | 55 |
| B-53 | | | | 2.20 | | | 45 |
| B-54 | | | | 2.85 | | | 35 |

TABLE 7

| Dispersion | Quaternary compound | Polymerization initiator: Before heating [g] | Polymerization initiator: After heating [g] | Surfactant [g] | Tg [° C.] | Tm [° C.] | Particle diameter [nm] |
|---|---|---|---|---|---|---|---|
| C | Present | 12 | 12 | 1.00 | 59 | 122 | 100 |
| D-1 | Absent | 24 | | 2.00 | 57 | 103 | 50 |
| D-2 | Absent | — | — | — | 59 | 103 | 50 |

The following describes, in order, production methods, evaluation methods, and evaluation results of the toners T-1 to T-78. In evaluations in which errors may occur, an evaluation value was calculated by calculating the arithmetic mean of an appropriate number of measured values in order to ensure that any errors were sufficiently small. The glass transition point (Tg) and the softening point (Tm) were each measured by a method described below, unless otherwise stated.

<Tg Measurement Method>

A heat absorption curve (vertical axis: heat flow (DSC signal), horizontal axis: temperature) of a sample (for example, a resin) was plotted using a differential scanning calorimeter ("DSC-6220", product of Seiko Instruments Inc.). Next, the glass transition point (Tg) of the sample was read from the heat absorption curve. The glass transition point (Tg) of the sample corresponds to a point of change in specific heat on the heat absorption curve (i.e., an intersection point of an extrapolation of the base line and an extrapolation of the inclined portion of the curve).

<Tm Measurement Method>

A sample (for example, a resin) was placed in a capillary rheometer ("CFT-500D", product of Shimadzu Corporation) and an S-shaped curve (horizontal axis: temperature, vertical axis: stroke) was plotted by causing melt-flow of 1 $cm^3$ of the sample under conditions of a die diameter of 1 mm, a plunger load of 20 $kg/cm^2$, and a heating rate of 6° C./minute. Tm of the sample was read from the S-shaped curve. The softening point (Tm) of the sample is a temperature on the S-shaped curve corresponding to a stroke value of $(S_1+S_2)/2$, where $S_1$ represents a maximum stroke value and $S_2$ represents a base line stroke value at low temperatures.

[Production Method of Toners T-1 to T-78]

(Toner Core Preparation)

A polyester resin (a binder resin for toner cores) was synthesized by causing a reaction between bisphenol A ethylene oxide adduct (more specifically, an alcohol produced through addition of ethylene oxide to a bisphenol A framework) and acids having multiple functional groups (more specifically, terephthalic acid and trimellitic anhydride) in the presence of a titanium oxide ($TiO_2$) catalyst. The resultant polyester resin had a hydroxyl value of 20 mgKOH/g, an acid value of 40 mgKOH/g, a Tm of 100° C., and a Tg of 48° C.

Next, 100 parts by mass of the polyester resin obtained as describe above, 5 parts by mass of a colorant (C.I. Pigment Blue 15:3, component: copper phthalocyanine pigment), and 5 parts by mass of a releasing agent ("Nissan Electol (registered Japanese trademark) WEP-3", product of NOF Corporation, an ester wax having a melting point of 73° C.) were mixed (dry-mixed) using an FM mixer ("FM-10C/I", product of Nippon Coke & Engineering Co., Ltd.) at a rotational speed of 2,400 rpm.

Next, the resultant mixture was melt-kneaded using a twin screw extruder ("PCM-30", product of Ikegai Corp.). Next, the resultant kneaded product was cooled. Next, the kneaded product that was cooled was pulverized using a mechanical pulverizer ("Turbo Mill T250", product of Freund-Turbo Corporation) under a condition of a set particle diameter of 5.6 μm. Next, the resultant pulverized product was classified using a classifier ("Elbow Jet EJ-LABO", product of Nittetsu Mining Co., Ltd.). As a result, toner cores having a volume median diameter ($D_{50}$) of 6 μm were obtained. The toner cores had a roundness of 0.931, a Tg of 50° C., a Tm of 98° C., a triboelectric charge of −20 μC/g, and a zeta potential at pH 4 of −20 mV.

(Preparation of Dispersions A-1 to A-6 and A-21 to A-25)

Into a 2-L flask equipped with a thermometer (thermocouple), a nitrogen inlet tube, a stirrer, and a condenser (heat exchanger), 250 g of a solvent (isobutanol), 6 g of 2-(diethylamino)ethyl methacrylate, and 6 g of methyl p-toluenesulfonate were added. Next, the flask contents were caused to react (quaternization reaction) under a nitrogen atmosphere at 80° C. for 1 hour to give a methacryloyl group-containing quaternary ammonium compound (2-(methacryloyloxy)ethyltrimethylammonium salt) in the flask. Next, 155 g of styrene, 75 g of butyl acrylate, and a specified amount of a peroxide polymerization initiator (t-butyl peroxy-2-ethylhexanoate, product of Arkema Yoshitomi, Ltd.) were further added into the flask with nitrogen gas flowing in the flask. The amount of the peroxide polymerization initiator at this point (before heating) was as shown in the column "Before heating [g]" under "Polymerization initiator" in Table 6. For example, as shown in Table 6, 14 g of the peroxide polymerization initiator (t-butyl peroxy-2-ethylhexanoate) was added into the flask in the preparation of the dispersion A-1.

Next, the flask contents were heated to 95° C. (polymerization temperature) and stirred for 3 hours. Next, 12 g of a peroxide polymerization initiator (t-butyl peroxy-2-ethylhexanoate, product of Arkema Yoshitomi, Ltd.) was further added into the flask, and the flask contents were stirred for 3 hours. Next, the flask contents were dried under environmental conditions of a high temperature (140° C.) and a reduced pressure (10 kPa) to remove the solvent. Next, the flask contents were broken up to give a coarsely pulverized product.

Next, the coarsely pulverized product was further pulverized using a mechanical pulverizer ("Turbo Mill T250", product of Freund-Turbo Corporation) under a condition of a set particle diameter of 10 μm to give a finely pulverized product. Next, 100 g of the finely pulverized product, a specified amount of a cationic surfactant ("QUARTAMIN (registered Japanese trademark) 24P", a 25% by mass aqueous lauryltrimethylammonium chloride solution, product of Kao Corporation), and 25 g of a 0.1N-aqueous sodium hydroxide solution were mixed to give a dispersion. The amount of the surfactant at this point was as shown in the column "Surfactant [g]" in Table 6. For example, as shown in Table 6, the amount of the cationic surfactant (QUARTAMIN 24P) was 1.65 g in the preparation of the dispersion A-1.

Next, ion exchanged water was added to the thus obtained dispersion to prepare 400 g of a slurry overall. Next, the slurry was loaded into a stainless steel pressure-resistant round-bottomed vessel. Next, the slurry was subjected to shear dispersion using a high-speed shear emulsification device ("CLEARMIX (registered Japanese trademark) CLM-2.2S", product of M Technique Co., Ltd.) for 30 minutes at a rotor rotational speed of 20,000 rpm under environmental conditions of a high temperature (140° C.) and a high pressure (0.5 MPa). Next, the vessel content was stirred at a rotor rotational speed of 15,000 rpm under cooling at a rate of 5° C./minute until the inner temperature of the vessel was 50° C. to give a dispersion (each of the dispersions A-1 to A-6 and A-21 to A-25) containing resin particles (particles substantially composed of a styrene-acrylic acid-based resin containing a positively chargeable charge control agent) in a solid concentration of 30% by mass. The number average particle diameter, the glass transition point (Tg), and the softening point (Tm) of the resin particles in each of the dispersions A-1 to A-6 and A-21 to A-25 were as shown in Table 6. For example, the resin particles contained in the dispersion A-1 had a number average particle diameter of 60 nm, a Tg of 59° C., and a Tm of 122° C.

(Preparation of Dispersions B-1 to B-6 and B-51 to B-54)

Into a 2-L flask equipped with a thermometer (thermocouple), a nitrogen inlet tube, a stirrer, and a condenser (heat exchanger), 250 g of a solvent (isobutanol) was added. Next, 155 g of styrene, 75 g of butyl acrylate, and a specified amount of a peroxide polymerization initiator (t-butyl peroxy-2-ethylhexanoate, product of Arkema Yoshitomi, Ltd.) were further added into the flask with nitrogen gas flowing in the flask. The amount of the peroxide polymerization initiator at this point (before heating) was as shown in the column "Before heating [g]" under "Polymerization initiator" in Table 6. For example, as shown in Table 6, 14 g of the peroxide polymerization initiator (t-butyl peroxy-2-ethylhexanoate) was added into the flask in the preparation of the dispersion B-1.

Next, the flask contents were heated to 95° C. (polymerization temperature) and stirred for 3 hours. Next, 12 g of a peroxide polymerization initiator (t-butyl peroxy-2-ethylhexanoate, product of Arkema Yoshitomi, Ltd.) was further added into the flask, and the flask contents were stirred for 3 hours. Next, the flask contents were dried under environmental conditions of a high temperature (140° C.) and a reduced pressure (10 kPa) to remove the solvent. Next, the flask contents were broken up to give a coarsely pulverized product.

Next, the coarsely pulverized product was further pulverized using a mechanical pulverizer ("Turbo Mill T250", product of Freund-Turbo Corporation) under a condition of a set particle diameter of 10 μm to give a finely pulverized product. Next, 100 g of the finely pulverized product, a specified amount of a cationic surfactant ("QUARTAMIN 24P", a 25% by mass aqueous lauryltrimethylammonium chloride solution, product of Kao Corporation), and 25 g of a 0.1N-aqueous sodium hydroxide solution were mixed to give a dispersion. The amount of the surfactant at this point was as shown in the column "Surfactant [g]" in Table 6. For example, as shown in Table 6, the amount of the cationic surfactant (QUARTAMIN 24P) was 1.65 g in the preparation of the dispersion B-1.

Next, ion exchanged water was added to the thus obtained dispersion to prepare 400 g of a slurry overall. Next, the slurry was loaded into a stainless steel pressure-resistant round-bottomed vessel. Next, the slurry was subjected to shear dispersion using a high-speed shear emulsification device ("CLEARMIX CLM-2.2S", product of M Technique Co., Ltd.) for 30 minutes at a rotor rotational speed of 20,000 rpm under environmental conditions of a high temperature (140° C.) and a high pressure (0.5 MPa). Next, the vessel content was stirred at a rotor rotational speed of 15,000 rpm under cooling at a rate of 5° C./minute until the inner temperature of the vessel was 50° C. to give a dispersion (each of the dispersions B-1 to B-6 and B-51 to B-54) containing resin particles (particles substantially composed of a styrene-acrylic acid-based resin containing no charge control agent) in a solid concentration of 30% by mass. The number average particle diameter, the glass transition point (Tg), and the softening point (Tm) of the resin particles in each of the dispersions B-1 to B-6 and B-51 to B-54 were as shown in Table 6. For example, the resin particles contained in the dispersion B-1 had a number average particle diameter of 60 nm, a Tg of 59° C., and a Tm of 122° C.

(Preparation of Dispersion C)

Into a 2-L flask equipped with a thermometer (thermocouple), a nitrogen inlet tube, a stirrer, and a condenser (heat exchanger), 250 g of a solvent (isobutanol), 6 g of 2-(diethylamino)ethyl methacrylate, and 6 g of methyl p-toluenesulfonate were added. Next, the flask contents were caused to react (quaternization reaction) under a nitrogen atmosphere at 80° C. for 1 hour to give a methacryloyl group-containing quaternary ammonium compound (2-(methacryloyloxy)ethyltrimethylammonium chloride) in the flask. Next, 230 g of butyl acrylate and 12 g of a peroxide polymerization initiator (t-butyl peroxy-2-ethylhexanoate, product of Arkema Yoshitomi, Ltd.) were further added into the flask with nitrogen gas flowing in the flask.

Next, the flask contents were heated to 95° C. (polymerization temperature) and stirred for 3 hours. Next, 12 g of a peroxide polymerization initiator (t-butyl peroxy-2-ethylhexanoate, product of Arkema Yoshitomi, Ltd.) was further added into the flask, and the flask contents were stirred for 3 hours. Next, the flask contents were dried under environmental conditions of a high temperature (140° C.) and a reduced pressure (10 kPa) to remove the solvent. Next, the flask contents were broken up to give a coarsely pulverized product.

Next, the coarsely pulverized product was further pulverized using a mechanical pulverizer ("Turbo Mill T250", product of Freund-Turbo Corporation) under a condition of a set particle diameter of 10 μm to give a finely pulverized product. Next, 100 g of the finely pulverized product, 1.00 g of a cationic surfactant ("QUARTAMIN 24P", a 25% by mass aqueous lauryltrimethylammonium chloride solution, product of Kao Corporation), and 25 g of a 0.1N-aqueous sodium hydroxide solution were mixed to give a dispersion.

Next, ion exchanged water was added to the thus obtained dispersion to prepare 400 g of a slurry overall. Next, the slurry was loaded into a stainless steel pressure-resistant round-bottomed vessel. Next, the slurry was subjected to shear dispersion using a high-speed shear emulsification device ("CLEARMIX CLM-2.2S", product of M Technique Co., Ltd.) for 30 minutes at a rotor rotational speed of 20,000 rpm under environmental conditions of a high temperature (140° C.) and a high pressure (0.5 MPa). Next, the vessel content was stirred at a rotor rotational speed of 15,000 rpm under cooling at a rate of 5° C./minute until the inner temperature of the vessel was 50° C. to give a dispersion (dispersion C) containing resin particles (particles substantially composed of an acrylic acid-based resin containing a positively chargeable charge control agent) in a solid concentration of 30% by mass. The resin particles contained in the dispersion C had a number average particle diameter of 100 nm, a Tg of 59° C., and a Tm of 122° C.

(Preparation of Dispersion D-1)

Into a 2-L flask equipped with a thermometer (thermocouple), a nitrogen inlet tube, a stirrer, and a condenser (heat exchanger), 250 g of a solvent (isobutanol) was added. Next, 230 g of butyl acrylate and 24 g of a peroxide polymerization initiator (t-butyl peroxy-2-ethylhexanoate, product of Arkema Yoshitomi, Ltd.) were further added into the flask with nitrogen gas flowing in the flask.

Next, the flask contents were heated to 95° C. (polymerization temperature) and stirred for 3 hours. Next, 12 g of a peroxide polymerization initiator (t-butyl peroxy-2-ethylhexanoate, product of Arkema Yoshitomi, Ltd.) was further added into the flask, and the flask contents were stirred for 3 hours. Next, the flask contents were dried under environmental conditions of a high temperature (140° C.) and a reduced pressure (10 kPa) to remove the solvent. Next, the flask contents were broken up to give a coarsely pulverized product.

Next, the coarsely pulverized product was further pulverized using a mechanical pulverizer ("Turbo Mill T250", product of Freund-Turbo Corporation) under a condition of a set particle diameter of 10 μm to give a finely pulverized product. Next, 100 g of the finely pulverized product, 2.00 g of a cationic surfactant ("QUARTAMIN 24P", a 25% by mass aqueous lauryltrimethylammonium chloride solution, product of Kao Corporation), and 25 g of a 0.1N-aqueous sodium hydroxide solution were mixed to give a dispersion.

Next, ion exchanged water was added to the thus obtained dispersion to prepare 400 g of a slurry overall. Next, the slurry was loaded into a stainless steel pressure-resistant round-bottomed vessel. Next, the slurry was subjected to shear dispersion using a high-speed shear emulsification device ("CLEARMIX CLM-2.2S", product of M Technique Co., Ltd.) for 30 minutes at a rotor rotational speed of 20,000 rpm under environmental conditions of a high temperature (140° C.) and a high pressure (0.5 MPa). Next, the vessel content was stirred at a rotor rotational speed of 15,000 rpm under cooling at a rate of 5° C./minute until the inner temperature of the vessel was 50° C. to give a dispersion (dispersion D-1) containing resin particles (particles substantially composed of an acrylic acid-based resin containing no charge control agent) in a solid concentration of 30% by mass. The resin particles contained in the dispersion D-1 had a number average particle diameter of 50 nm, a Tg of 57° C., and a Tm of 103° C.

(Preparation of Dispersion D-2)

Into a reaction vessel, 30 parts by mole of bisphenol A propylene oxide adduct, 20 parts by mole of bisphenol A ethylene oxide adduct, 44 parts by mole of fumaric acid, and 6 parts by mole of trimellitic acid were added. Next, the vessel contents were caused to react under a nitrogen atmosphere in the presence of a catalyst (dibutyl tin oxide) to give a polyester resin having a number average molecular weight (Mn) of 3,000, a mass average molecular weight (Mw) of 8,500, a Mw/Mn (molecular weight distribution) of 2.8, a glass transition point (Tg) of 59° C., and a softening point (Tm) of 103° C.

Next, 1,300 g of the thus obtained polyester resin was put in a vessel in a mixer equipped with a temperature regulating jacket ("T.K. Hivis Disper Mix HM-3D-5", product of PRIMIX Corporation), and the vessel content was melt-kneaded at a temperature of 120° C. Next, 100 g of triethanolamine and 80 g of a 25% by mass aqueous solution of an anionic surfactant ("Emal (registered Japanese trademark) 0", product of Kao Corporation, component: sodium lauryl sulfate) were added into the vessel, and the vessel contents were kneaded at a planetary rotation speed of 50 rpm for 15 minutes. Next, 2870 g of ion exchanged water at 98° C. was poured into the vessel at a rate of 50 g/minute to give an emulsion of the polyester resin. Next, the vessel content was cooled at a rate of 5° C./minute until the inner temperature of the vessel was 50° C. to give a dispersion (dispersion D-2) containing resin particles (particles substantially composed of a polyester resin containing no charge control agent) in a solid concentration of 30% by mass. The resin particles contained in the dispersion D-2 had a number average particle diameter of 50 nm, a Tg of 59° C., and a Tm of 103° C.

(Shell Layer Formation)

A 1-L three-necked flask having a thermometer and a stirring impeller was set up in a water bath. Next, 300 mL of ion exchanged water was added into the flask, and the inner temperature of the flask was maintained at 30° C. using the water bath. Next, the flask content was adjusted to pH 4 through addition of dilute hydrochloric acid to the flask.

Next, with respect to each of the toners T-1 to T-78, 300 g of the toner cores (powder) prepared as described above, a first shell material (one of the dispersions A-1 to A-6, A-21 to A-25, and C that is specified for the toner in Tables 1 to 5) in an amount shown in Tables 1 to 5, and a second shell material (one of the dispersions B-1 to B-6, B-51 to B-54, D-1, and D-2 that is specified for the toner in Tables 1 to 5) in an amount shown in Tables 1 to 5 were added into the flask. For example, as shown in Table 1, 300 g of the toner cores, 36 g of the dispersion A-2 (solid concentration: 30% by mass), and 4 g of the dispersion B-5 (solid concentration: 30% by mass) were added into the flask in the production of the toner T-1. Next, the flask contents were sufficiently stirred. As a result, a dispersion of the toner cores was obtained in the flask.

Next, 300 mL of ion exchanged water was added into the flask, and the flask contents were heated to 65° C. at a rate of 2° C./minute under stirring at a rotational speed of 100 rpm. Once the inner temperature of the flask was 65° C., a liquid mixture (temperature: 65° C.) including 20 g of a 0.5 moles/liter aqueous disodium hydrogen phosphate solution and 10 g of a 10% by mass aqueous solution of an anionic surfactant ("Emal 0", product of Kao Corporation, component: sodium lauryl sulfate) was added into the flask. Furthermore, heating of the flask contents was continued at a rate of 1.0° C./minute under stirring at a rotational speed of 100 rpm. Heating of the flask contents was stopped once the roundness of the toner reached 0.965. Subsequently, the flask contents were rapidly cooled to room temperature (approximately 25° C.) through addition of cold water into the flask, and the flask contents were adjusted to pH 7 (neutralization). As a result, a dispersion of toner mother particles was obtained.

(Washing)

The dispersion of the toner mother particles obtained as described above was filtered (solid-liquid separation) using a Buchner funnel to obtain a wet cake of the toner mother particles. Next, the wet cake of the toner mother particles was re-dispersed in ion exchanged water. Dispersion and filtration were repeated 6 times for washing the toner mother particles. The thus obtained toner mother particles had a mean volume diameter (MV) of 6 μm and a releasing agent content of 5% by mass. The releasing agent content was determined from an endothermic peak measured using a differential scanning calorimeter ("DSC-6220", product of Seiko Instruments Inc.).

(Drying)

Next, the washed toner mother particles were dispersed in a 50% by mass aqueous ethanol solution. Thus, a slurry of the toner mother particles was obtained. Next, the toner mother particles in the slurry were dried using a continuous type surface modifier ("Coatmizer (registered Japanese trademark)", product of Freund Corporation) under conditions of a hot air temperature of 45° C. and a flow rate of 2 $m^3$/minute. During the drying, ethanol containing 0.2 parts by mass of a first external additive ("AEROSIL (registered Japanese trademark) REA200", silica particles, product of Nippon Aerosil Co., Ltd.) was sprayed to 100 parts by mass of the toner mother particles. As a result, toner mother particles having the first external additive (hereinafter, referred to as first-external-additive-added toner particles) were obtained.

(External Addition)

After drying, another external additive was further added to the first-external-additive-added toner particles. More specifically, 100 parts by mass of the first-external-additive-added toner particles and 0.4 parts by mass of a second external additive (positively chargeable silica particles obtained through surface treatment of silica particles ("AEROSIL 90G", product of Nippon Aerosil Co., Ltd.) having a number average primary particle diameter of 20 nm with silicone oil and aminosilane) were mixed for 5 minutes using an FM mixer ("FM-10C/I", product of Nippon Coke & Engineering Co., Ltd.) to cause the second external additive (silica particles) to adhere to the surface of the toner mother particles. Next, the resultant powder was sifted using a 300 mesh sieve (opening: 48 μm). As a result, the toner (each of the toners T-1 to T-78) including a large number of the toner particles was obtained.

With respect to each of the toners T-1 to T-78 obtained as described above, a number average particle diameter of the first resin particles (resin particles containing a charge control agent) contained in a shell layer and a number average particle diameter of the second resin particles (resin particles containing no charge control agent) in the shell layer were measured using a scanning electron microscope (SEM) ("JSM-6700F", product of JEOL Ltd.). The number average particle diameter of the first resin particles and the number average particle diameter of the second resin particles were each a number average of diameters of representative circles of primary particles. The measurement results were as shown in Tables 1 to 5. The number average particle diameter of the first resin particles and the number average particle diameter of the second resin particles were each equal to the particle diameter at the time of addition thereof (see Tables 6 and 7). Both the first resin particles and the second resin particles had a sharp particle size distribution and substantially included only resin particles each having a particle diameter (representative circle diameter) in a range of from "number average particle diameter−3 nm" to "number average particle diameter+3 nm". For example, in the toner T-1, the number average particle diameter of the first resin particles was 100 nm, the number average particle diameter of the second resin particles was 50 nm, and the particle diameter difference (particle diameter difference obtained by subtracting the number average particle diameter of the second resin particles from the number average particle diameter of the first resin particles) was +50 nm as shown in Table 1.

[Evaluation Methods]

Each of samples (toners T-1 to T-78) was evaluated as described below.

(Thermal-Stress Resistance Evaluation)

Figure 3:
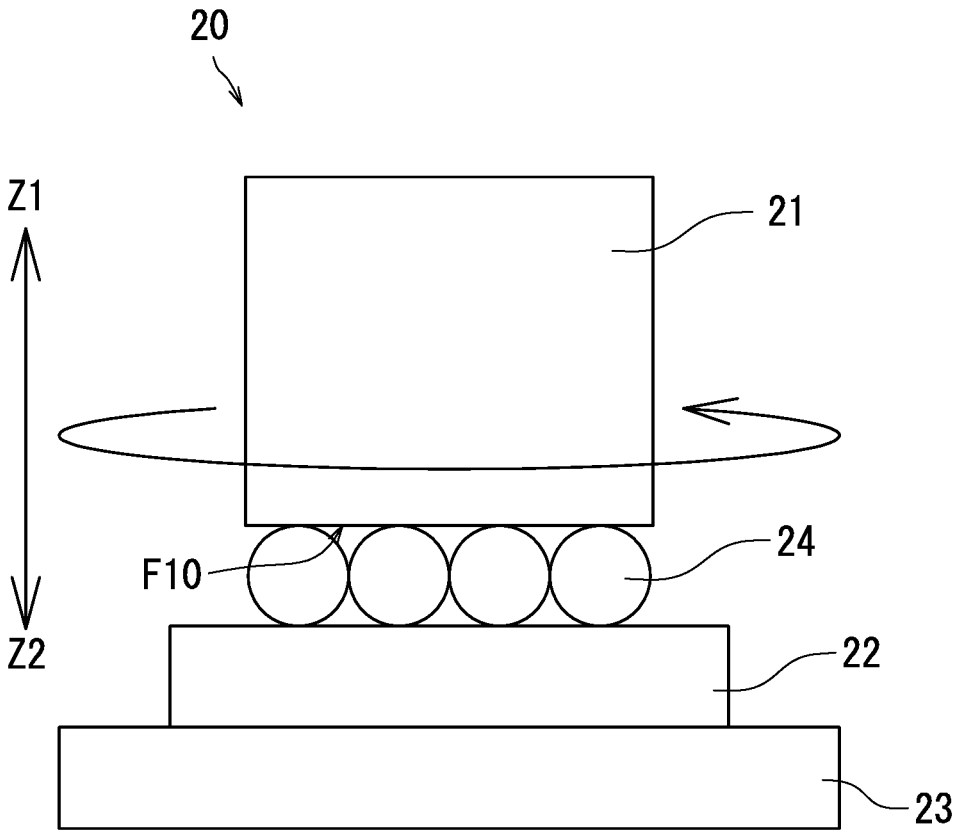
FIG. 3 is a schematic illustration of an evaluation apparatus used in thermal-stress resistance evaluation of examples of the present disclosure.

A rheometer ("MCR-301", product of Anton Paar GmbH) was used as an evaluation apparatus. FIG. 3 is a schematic illustration of the evaluation apparatus (rheometer). The following describes a method for evaluating thermal-stress resistance with reference to FIG. 3.

As illustrated in FIG. 3, an evaluation apparatus 20 includes an aluminum indenter 21, a stainless steel (SUS) plate 22, and a heater 23. The indenter 21 is in a cylindrical shape with a bottom surface F10 having an area of 0.785 $cm^2$. The plate 22 is fixed. The indenter 21 is driven to move by a motor or the like. A distance between the bottom surface F10 of the indenter 21 and a top surface of the plate 22 changes with movement of the indenter 21 in a direction (Z direction) perpendicular to the top surface of the plate 22. A specified pressure can be applied to toner particles 24 by causing the indenter 21 to approach the plate 22 (move in a Z2 direction) with the toner particles 24 placed between the bottom surface F10 of the indenter 21 and the top surface of the plate 22. The indenter 21 is also driven by the motor or the like to rotate about its rotation axis, which is a Z axis.

In the thermal-stress resistance evaluation, the toner particles 24 were heated at a rate of 2° C./minute while a pressing load is being applied onto the toner particles 24 by the indenter 21 rotating in 0.010 rotation angle increments at a frequency of 1 Hz. A pressing load of 3.0 $N/cm^2$ was applied onto the toner particles 24, and a temperature at which the rotational torque of the indenter 21 was 5 mN·m was measured. The rotational torque tends to increase to be 5 mN·m or greater once the toner particles start melting and tends to start decreasing once the toner particles have melted to a certain degree. The thermal-stress resistance was evaluated as good if the temperature at which the rotational torque was 5 mN·m was 57° C. or greater. The thermal-stress resistance was evaluated as poor if the temperature at which the rotational torque was 5 mN·m was less than 57° C.

(Preparation of Evaluation Carrier)

Materials were blended to give 39.7% by mole in terms of MnO, 9.9% by mole in terms of MgO, 49.6% by mole in terms of $Fe_2O_3$, and 0.8% by mole in terms of SrO, and water was added thereto. The resultant mixture was pulverized over 10 hours using a wet ball mill and subsequently mixed. Next, the resultant mixture was dried and subsequently maintained at 950° C. for 4 hours.

Next, the mixture was pulverized over 24 hours using a wet ball mill to prepare a slurry. Next, granules were formed from the slurry and subsequently dried. Next, the dried granules were maintained at 1,270° C. for 6 hours in an atmosphere with an oxygen concentration of 2% and subsequently broken up. Next, particle size adjustment was performed to give manganese ferrite particles (carrier cores) having an average particle diameter of 35 μm and a saturation magnetization of 70 $Am^2/kg$ in response to application of a magnetic field at 3,000 ($10^3/4\pi \cdot A/m$).

Next, a polyamide-imide resin (copolymer of trimellitic anhydride and 4,4'-diaminodiphenyl methane) was dissolved in methyl ethyl ketone to prepare a resin solution. Next, a fluororesin (tetrafluoroethylene-hexafluoropropylene copolymer: FEP) and silicon oxide (2% by mass relative to overall resin amount) were dispersed in the resin solution to give 150 g of a carrier coat liquid in terms of the solids content. A mass ratio of the polyamide-imide resin and the FEP (polyamide-imide resin:FEP) in the thus obtained carrier coat liquid was 2:8, and the resin solution had a solid concentration of 10% by mass.

Next, 10 kg of the manganese ferrite particles (carrier cores) were coated with the carrier coat liquid using a tumbling fluidized bed coater ("SPIRA COTA (registered Japanese trademark) SP-25", product of OKADA SEIKO CO., LTD.). Next, the resin-coated manganese ferrite particles were sintered at 220° C. for 1 hour. Next, the resultant sintered product was cooled and subsequently broken up to give a resin-coated ferrite carrier (evaluation carrier) at a resin coverage of 3% by mass.

(Preparation of Evaluation Developer)

Under environmental conditions of a temperature of 25° C. and a relative humidity of 50%, 0.5 g of a sample (toner) and 10 g of the evaluation carrier prepared as described above were loaded into a polyethylene vessel having a capacity of 20 mL. The vessel contents were mixed at a rotational speed of 100 rpm for a specified period of time using a Nauta mixer (registered Japanese trademark) produced by Hosokawa Micron Corporation to prepare an evaluation developer (two-component developer).

(Charge Stability Evaluation)

With respect to each of the samples (toners T-1 to T-78), evaluation developers were respectively prepared through mixing for 3 minutes, 30 minutes, and 60 minutes. The charge (μC/g) of each evaluation developer was measured using a Q/m meter ("210HS-2", product of TREK, INC.). More specifically, the evaluation developer was placed in a measurement cell of the Q/m meter, and only the toner of the evaluation developer was drawn in through a stainless steel screen for 10 seconds. The charge (unit: μC/g) of the sample (toner) in the evaluation developer was calculated based on an expression "total amount of electricity (unit: μC) of drawn toner/amount of drawn toner (unit: g)". The charge stability of the sample (toner) was evaluated in accordance with the following standard. With respect to charges of the evaluation developers that were respectively prepared through mixing for different periods of time (3 minutes, 30 minutes, and 60 minutes), a difference between a smallest charge and a greatest charge was determined. The charge stability was evaluated as good if the difference was 3 μC/g or less. The charge stability was evaluated as poor if the difference was greater than 3 μC/g.

(Low-Temperature Fixability Evaluation)

A color multifunction peripheral ("TASKalfa5550ci", product of KYOCERA Document Solutions Inc.) including a fixing device was used as an evaluation apparatus. A surface material of a heat roll of the fixing device was a PFA (a copolymer of tetrafluoroethylene with perfluoroalkyl vinyl ether) tube having a film thickness of 30 μm±10 μm and a surface roughness (Ra, arithmetic mean roughness) of 5 μm. With respect to each of the samples (toners T-1 to T-78), an evaluation developer was prepared as described above (mixing in Nauta mixer: 30 minutes). The evaluation developer was loaded into a developing device of the evaluation apparatus, and the sample (toner for replenishment use) was loaded into a toner container of the evaluation apparatus.

A solid image having an area of 25 $cm^2$ was formed on a recording medium (A4 size plain paper, landscape paper conveyance) using the evaluation apparatus under conditions of a temperature of 25° C., a relative humidity of 50%, and a toner load of 15 mg. Fixability of the sample (toner) was evaluated using the thus formed image (more specifically, unfixed toner image). More specifically, the paper on which the image was formed as described above was passed through the fixing device of the evaluation apparatus at a linear velocity of 300 mm/second. Next, whether or not the toner was fixed and whether or not offset occurred were confirmed. In such testing, the fixing temperature was varied within a range of from 80° C. to 200° C., and a minimum temperature at which the toner was fixable to the paper (minimum fixing temperature) and a maximum temperature at which the toner was fixable without the occurrence of offset (maximum fixing temperature) were measured. The fixing temperature of the fixing device (surface temperature of the heat roll) was increased from 80° C. in increments of 5° C. A fixable temperature range (=maximum fixing temperature−minimum fixable temperature) was determined based on the minimum fixing temperature and the maximum fixing temperature measured as described above. In the maximum fixing temperature measurement, whether or not offset occurred was confirmed by visual observation. It was determined that offset occurred when the toner adhered to the fixing roller. In the minimum fixing temperature measurement, whether or not the toner was fixable at a given temperature was confirmed through a fold-rubbing test such as described below (i.e., by measuring the length of toner peeling at a fold). The paper was folded such that the surface on which the image was formed was folded inward, and a 1 kg weight covered with cloth was rubbed back and forth five times on the fold. Next, the paper was opened out to observe a folded portion of the paper (portion on which the solid image was formed). The length of toner peeling of the folded portion (peeling length) was measured. The minimum fixing temperature was determined to be the lowest temperature among fixing temperatures for which the peeling length was less than 1 mm.

The low-temperature fixability was evaluated in accordance with the following standard.

Good: a minimum fixing temperature of no greater than 100° C. and a fixable temperature range of 80° C. or greater Poor: a minimum fixing temperature of greater than 100° C. or a fixable temperature range of less than 80° C.

[Evaluation Results]

Tables 8 to 10 show evaluation results of the toners T-1 to T-78.

TABLE 8

| | | Charge stability [μC/g] | | | | Fixable temperature range (Minimum fixing temp./ Maximum fixing temp.) | Thermal-stress resistance (at 5 mN · m) |
|---|---|---|---|---|---|---|---|
| | Toner | 3 min | 30 min | 60 min | Difference | [° C.] | [° C.] |
| Example 1 | T-1 | 25 | 24 | 25 | 1 | 100 (100/200) | 59 |
| Example 2 | T-2 | 24 | 25 | 25 | 1 | 105 (95/200) | 59 |
| Example 3 | T-3 | 22 | 20 | 21 | 2 | 110 (90/200) | 58 |
| Example 4 | T-4 | 21 | 21 | 22 | 1 | 105 (95/200) | 58 |
| Example 5 | T-5 | 18 | 17 | 18 | 1 | 105 (85/190) | 57 |
| Example 6 | T-6 | 18 | 16 | 17 | 2 | 105 (90/195) | 58 |
| Example 7 | T-7 | 24 | 25 | 24 | 1 | 100 (100/200) | 59 |
| Example 8 | T-8 | 25 | 25 | 24 | 1 | 100 (100/200) | 60 |
| Example 9 | T-9 | 21 | 20 | 22 | 2 | 100 (100/200) | 59 |
| Example 10 | T-10 | 20 | 22 | 21 | 2 | 105 (95/200) | 58 |
| Example 11 | T-11 | 18 | 17 | 16 | 2 | 105 (95/200) | 58 |
| Example 12 | T-12 | 16 | 18 | 17 | 2 | 105 (90/195) | 57 |
| Example 13 | T-13 | 24 | 24 | 25 | 1 | 100 (100/200) | 59 |
| Example 14 | T-14 | 25 | 24 | 25 | 1 | 100 (100/200) | 59 |
| Example 15 | T-15 | 24 | 25 | 24 | 1 | 100 (100/200) | 59 |

TABLE 9

| | | Charge stability [μC/g] | | | | Fixable temperature range (Minimum fixing temp./ Maximum fixing temp.) | Thermal-stress resistance (at 5 mN · m) |
|---|---|---|---|---|---|---|---|
| | Toner | 3 min | 30 mm | 60 min | Difference | [° C.] | [° C.] |
| Comparative Example 1 | T-21 | 24 | 25 | 24 | 1 | 95 (105/200) Poor | 59 |
| Comparative Example 2 | T-22 | 25 | 24 | 24 | 1 | 100 (100/200) | 56 Poor |
| Comparative Example 3 | T-23 | 25 | 21 | 23 | 4 Poor | 100 (100/200) | 57 |
| Comparative Example 4 | T-24 | 24 | 25 | 25 | 1 | 90 (110/200) Poor | 60 |
| Comparative Example 5 | T-25 | 25 | 24 | 25 | 1 | 85 (115/200) Poor | 60 |
| Comparative Example 6 | T-26 | 25 | 25 | 24 | 1 | 95 (105/200) Poor | 59 |
| Comparative Example 7 | T-27 | 21 | 22 | 22 | 1 | 95 (105/200) Poor | 58 |
| Comparative Example 8 | T-28 | 22 | 22 | 21 | 1 | 100 (95/195) | 56 Poor |
| Comparative Example 9 | T-29 | 20 | 17 | 21 | 4 Poor | 100 (90/190) | 57 |
| Comparative Example 10 | T-30 | 22 | 22 | 21 | 1 | 95 (105/200) Poor | 59 |

TABLE 9-continued

| | Toner | Charge stability [μC/g] 3 min | 30 mm | 60 min | Difference | Fixable temperature range (Minimum fixing temp./ Maximum fixing temp.) [° C.] | Thermal-stress resistance (at 5 mN · m) [° C.] |
|---|---|---|---|---|---|---|---|
| Comparative Example 11 | T-31 | 21 | 22 | 22 | 1 | 90 (110/200) Poor | 59 |
| Comparative Example 12 | T-32 | 20 | 21 | 22 | 2 | 90 (110/200) Poor | 59 |
| Comparative Example 13 | T-33 | 18 | 17 | 17 | 1 | 95 (105/200) Poor | 55 Poor |
| Comparative Example 14 | T-34 | 18 | 17 | 17 | 1 | 100 (95/195) | 55 Poor |
| Comparative Example 15 | T-35 | 18 | 16 | 17 | 2 | 100 (90/190) | 56 Poor |
| Comparative Example 16 | T-36 | 18 | 17 | 17 | 1 | 90 (110/200) Poor | 59 |
| Comparative Example 17 | T-37 | 17 | 17 | 18 | 1 | 95 (105/200) Poor | 59 |
| Comparative Example 18 | T-38 | 16 | 18 | 17 | 2 | 95 (105/200) Poor | 57 |
| Comparative Example 19 | T-41 | 25 | 22 | 21 | 4 Poor | 95 (105/200) Poor | 58 |
| Comparative Example 20 | T-42 | 25 | 23 | 22 | 3 | 90 (110/200) Poor | 60 |
| Comparative Example 21 | T-43 | 25 | 21 | 23 | 4 Poor | 100 (100/200) | 58 |
| Comparative Example 22 | T-44 | 25 | 21 | 21 | 4 Poor | 95 (105/200) Poor | 58 |
| Comparative Example 23 | T-45 | 22 | 18 | 19 | 4 Poor | 100 (100/200) | 57 |
| Comparative Example 24 | T-46 | 21 | 22 | 18 | 4 Poor | 90 (110/200) Poor | 59 |
| Comparative Example 25 | T-47 | 20 | 22 | 18 | 4 Poor | 105 (95/200) | 57 |
| Comparative Example 26 | T-48 | 21 | 19 | 17 | 4 Poor | 100 (100/200) | 58 |
| Comparative Example 27 | T-49 | 15 | 18 | 13 | 5 Poor | 100 (95/195) | 57 |
| Comparative Example 28 | T-50 | 14 | 13 | 17 | 4 Poor | 95 (105/200) Poor | 58 |
| Comparative Example 29 | T-51 | 13 | 15 | 17 | 4 Poor | 100 (100/200) | 57 |
| Comparative Example 30 | T-52 | 13 | 16 | 18 | 5 Poor | 100 (95/195) | 57 |
| Comparative Example 31 | T-61 | 25 | 25 | 25 | 0 | 95 (105/200) Poor | 58 |
| Comparative Example 32 | T-62 | 25 | 24 | 25 | 1 | 90 (110/200) Poor | 59 |
| Comparative Example 33 | T-63 | 17 | 13 | 15 | 4 Poor | 105 (80/185) | 54 Poor |
| Comparative Example 34 | T-64 | 13 | 18 | 14 | 5 Poor | 105 (85/190) | 56 Poor |
| Comparative Example 35 | T-65 | 25 | 25 | 25 | 0 | 90 (110/200) Poor | 58 |
| Comparative Example 36 | T-66 | 25 | 24 | 25 | 1 | 90 (110/200) Poor | 58 |
| Comparative Example 37 | T-67 | 15 | 13 | 18 | 5 Poor | 105 (90/195) | 57 |
| Comparative Example 38 | T-68 | 14 | 18 | 15 | 4 Poor | 105 (85/190) | 58 |

TABLE 10

| | Toner | Charge stability [μC/g] 3 min | 30 min | 60 min | Difference | Fixable temperature range (Minimum fixing temp./ Maximum fixing temp.) [° C.] | Thermal-stress resistance (at 5 mN · m) [° C.] |
|---|---|---|---|---|---|---|---|
| Comparative Example 39 | T-71 | 1 | 5 | 2 | 4 Poor | 105 (95/200) | 59 |
| Comparative Example 40 | T-72 | 1 | 2 | 5 | 4 Poor | 100 (100/200) | 59 |
| Comparative Example 41 | T-73 | 3 | 5 | 1 | 4 Poor | 105 (85/190) | 57 |
| Comparative Example 42 | T-74 | 5 | 2 | 1 | 4 Poor | 105 (90/195) | 58 |
| Comparative Example 43 | T-75 | 1 | 5 | 2 | 4 Poor | 100 (100/200) | 58 |
| Comparative Example 44 | T-76 | 2 | 1 | 5 | 4 Poor | 100 (100/200) | 58 |
| Comparative Example 45 | T-77 | 1 | 5 | 2 | 4 Poor | 105 (90/195) | 57 |
| Comparative Example 46 | T-78 | 2 | 1 | 5 | 4 Poor | 105 (95/200) | 58 |

The toners T-1 to T-15 (toners according to Examples 1 to 15) each had the above-described basic structure. More specifically, the shell layers of each of the toners according to Examples 1 to 15 contained the first resin particles containing a charge control agent (more specifically, a positively chargeable charge control agent) and the second resin particles (more specifically, resin particles containing no charge control agent). As shown in Table 1, the number average particle diameter of the first resin particles was in a range of from 60 nm to 100 nm, the number average particle diameter of the second resin particles was in a range of from 10 nm to 50 nm, and the first-second particle diameter difference (particle diameter difference obtained by subtracting the number average particle diameter of the second resin particles from the number average particle diameter of the first resin particles) was in a range of from +20 nm to +50 nm. Furthermore, as shown in Tables 1, 6, and 7, the softening point (Tm) of the first resin particles was higher than the softening point (Tm) of the second resin particles. Furthermore, as shown in Table 1, the first resin ratio $R_1$ (ratio of the first resin amount $M_A$ to the sum of the first resin amount $M_A$ and the second resin amount $M_B$) was in a range of from 0.7 to 0.9.

As shown in Table 8, the toners according to Examples 1 to 15 each had good results in all the charge stability evaluation, the fixability evaluation, and the thermal-stress resistance evaluation. The toners according to Examples 1 to 15 were each excellent in low-temperature fixability, thermal-stress resistance, and charge stability. Furthermore, the toners according to Examples 1 to 15 each had a shell coverage $R_S$ of 90% or greater.

The toners T-21, T-24, T-25, T-27, T-30, T-31, T-33, T-36, and T-37 (toners according to Comparative Examples 1, 4, 5, 7, 10, 11, 13, 16, and 17) were each poor in low-temperature fixability compared to the toners according to Examples 1 to 15. The reason for the above is thought to be that the first-second particle diameter difference of each of the toners T-21, T-24, T-25, T-27, T-30, T-31, T-33, T-36, and T-37 was too large, and therefore the second resin particles were restricted from functioning as collapse points.

The toners T-22, T-28, and T-34 (toners according to Comparative Examples 2, 8, and 14) were each poor in thermal-stress resistance compared to the toners according to Examples 1 to 15. The reason for the above is thought to be that the number average particle diameter of the second resin particles of the toners T-22, T-28, and T-34 was too small, and therefore sufficient strength of the shell layers could not be ensured.

The toners T-26, T-32, T-38, T-42, T-46, and T-50 (toners according to Comparative Examples 6, 12, 18, 20, 24, and 28) were each poor in low-temperature fixability compared to the toners according to Examples 1 to 15. The reason for the above is thought to be that the number average particle diameter of the second resin particles of each of the toners T-26, T-32, T-38, T-42, T-46, and T-50 was too large, and therefore the second resin particles were restricted from functioning as collapse points.

The toners T-23, T-29, T-43, T-47, and T-51 (toners according to Comparative Examples 3, 9, 21, 25, and 29) were each poor in charge stability compared to the toners according to Examples 1 to 15. The reason for the above is thought to be that the number average particle diameter of the first resin particles of the toners T-23, T-29, T-43, T-47, and T-51 was too small, and therefore triboelectric charging of the positively chargeable first resin particles and the carrier particles was unstable.

The toner T-35 (toner according to Comparative Example 15) was poor in thermal-stress resistance compared to the toners according to Examples 1 to 15. The reason for the above is thought to be that the number average particle diameter of the first resin particles of the toner T-35 was too small, and therefore sufficient strength of the shell layers could not be ensured.

The toners T-41, T-44, T-45, T-48, T-49, and T-52 (toners according to Comparative Examples 19, 22, 23, 26, 27, and 30) were each poor in charge stability compared to the toners according to Examples 1 to 15. The reason for the above is thought to be that the first-second particle diameter difference of the toners T-41, T-44, T-45, T-48, T-49, and T-52 was too small, and therefore triboelectric charging of the positively chargeable first resin particles and the carrier particles was unstable.

The toners T-61, T-62, T-65, and T-66 (toners according to Comparative Examples 31, 32, 35, and 36) were each poor in low-temperature fixability compared to the toners according to Examples 1 to 15. The reason for the above is thought to be that the first resin ratio $R_1$ of the toners T-61, T-62, T-65, and T-66 was too large, and therefore the number or the area of collapse points in the shell layers was insufficient.

The toners T-63, T-64, T-67, and T-68 (toners according to Comparative Examples 33, 34, 37, and 38) were each poor in charge stability compared to the toners according to Examples 1 to 15. The reason for the above is thought to be that the first resin ratio $R_1$ of the toners T-63, T-64, T-67, and T-68 was too small, and therefore triboelectric charging of the positively chargeable first resin particles and the carrier particles was unstable.

The toners T-71 to T-78 (toners according to Comparative Examples 39 to 46) were each poor in charge stability compared to the toners according to Examples 1 to 15. The reason for the above is thought to be that in the toners T-71 to T-78, the number average particle diameter of the first resin particles was smaller than the number average particle diameter of the second resin particles, and therefore triboelectric charging of the positively chargeable first resin particles and the carrier particles was unstable.

What is claimed is:

1. An electrostatic latent image developing toner comprising a plurality of toner particles each including a core and a shell layer disposed over a surface of the core, wherein the shell layer contains first resin particles having a number average particle diameter of at least 60 nm and no greater than 100 nm, and second resin particles having a number average particle diameter of at least 10 nm and no greater than 50 nm, a particle diameter difference obtained by subtracting the number average particle diameter of the second resin particles from the number average particle diameter of the first resin particles is at least +20 nm and no greater than +50 nm, the first resin particles contain a charge control agent, the first resin particles have a higher softening point than a softening point of the second resin particles, a ratio of a mass of the first resin particles to a sum of the mass of the first resin particles and a mass of the second resin particles is at least 0.7 and no greater than 0.9, and the first resin particles protrude further outward from a surface of the toner particle than the second resin particles.

2. The electrostatic latent image developing toner according to claim 1, wherein the core contains a polyester resin, and the first resin particles contain a styrene-acrylic acid-based resin.

3. The electrostatic latent image developing toner according to claim 2, wherein the styrene-acrylic acid-based resin is a polymer of a styrene-based monomer, an alkyl(meth)acrylate, and a (meth)acryloyl group-containing quaternary ammonium compound.

4. The electrostatic latent image developing toner according to claim 3, wherein the second resin particles contain a styrene-acrylic acid-based resin.

5. The electrostatic latent image developing toner according to claim 3, wherein the (meth)acryloyl group-containing quaternary ammonium compound is a quaternary ammonium compound represented by formula (A) shown below, (A)

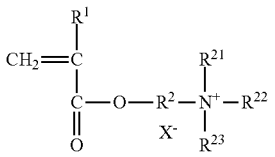

wherein in the formula (A), $R^1$ represents a hydrogen atom or a methyl group, $R^{21}$, $R^{22}$, and $R^{23}$ each represent, independently of one another, a hydrogen atom, an optionally substituted alkyl group, or an optionally substituted alkoxy group, $R^2$ represents an optionally substituted alkylene group, and $X^-$ represents an anion forming an ionic bond with $N^+$ in the formula (A).

6. The electrostatic latent image developing toner according to claim 1, wherein the second resin particles contain a polyester resin.

7. The electrostatic latent image developing toner according to claim 6, wherein the core contains a polyester resin, and the first resin particles contain an acrylic acid-based resin having a repeating unit derived from a (meth)acryloyl group-containing quaternary ammonium compound.

8. The electrostatic latent image developing toner according to claim 7, wherein the acrylic acid-based resin having a repeating unit derived from a (meth)acryloyl group-containing quaternary ammonium compound is a polymer of an alkyl (meth)acrylate and a quaternary ammonium compound represented by formula (A) shown below, (A)

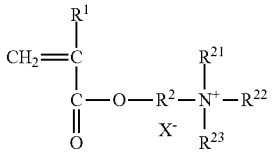

wherein in the formula (A), $R^1$ represents a hydrogen atom or a methyl group, $R^{21}$, $R^{22}$, and $R^{23}$ each represent, independently of one another, a hydrogen atom, an optionally substituted alkyl group, or an optionally substituted alkoxy group, $R^2$ represents an optionally substituted alkylene group, and $X^-$ represents an anion forming an ionic bond with $N^+$ in the formula (A).

9. The electrostatic latent image developing toner according to claim 1, wherein the first resin particles contain an acrylic acid-based resin having a repeating unit derived from a (meth)acryloyl group-containing quaternary ammonium compound, and the second resin particles contain an acrylic acid-based resin containing no charge control agent.

10. The electrostatic latent image developing toner according to claim 9, wherein the acrylic acid-based resin having a repeating unit derived from a (meth)acryloyl group-containing quaternary ammonium compound is a polymer of an alkyl (meth)acrylate and a quaternary ammonium compound represented by formula (A) shown below, (A)

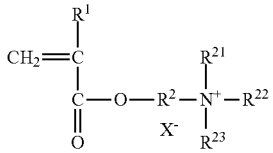

wherein in the formula (A), $R^1$ represents a hydrogen atom or a methyl group, $R^{21}$, $R^{22}$, and $R^{23}$ each represent, independently of one another, a hydrogen atom, an optionally substituted alkyl group, or an optionally substituted alkoxy group, $R^2$ represents an optionally substituted alkylene group, and $X^-$ represents an anion forming an ionic bond with $N^+$ in the formula (A).

11. The electrostatic latent image developing toner according to claim 1, wherein the second resin particles contain no charge control agent.

12. The electrostatic latent image developing toner according to claim 1, wherein a percentage of area of regions of the surface of the core that are covered with at least one of the first and second resin particles is at least 90% and no greater than 100%.

13. The electrostatic latent image developing toner according to claim 1, wherein a softening point difference obtained by subtracting the softening point of the second resin particles from the softening point of the first resin particles is at least +10° C.

14. The electrostatic latent image developing toner according to claim 1, wherein the first resin particles have a softening point of at least 120° C. and no greater than 130° C., and the second resin particles have a softening point of at least 100° C. and no greater than 110° C.

15. The electrostatic latent image developing toner according to claim 1, wherein the toner particles further include inorganic particles as an external additive.

16. The electrostatic latent image developing toner according to claim 1, wherein the first resin particles have a softening point of at least 55° C. and no greater than 63° C., and the second resin particles have a softening point of at least 55° C. and no greater than 63° C.

* * * * *